US009320402B2

(12) United States Patent
Krondorfer et al.

(10) Patent No.: US 9,320,402 B2
(45) Date of Patent: Apr. 26, 2016

(54) SUPPLY TANK FOR AN EXTRACTOR CLEANING MACHINE

(75) Inventors: Harald Krondorfer, Aurora, OH (US); Steven J. Paliobeis, Mentor, OH (US); Robert A. Salo, Mentor, OH (US); Patrick Quinn, North Canton, OH (US); Kevin Vail, North Royalton, OH (US); Euan Macleod, Hung Hom (CN)

(73) Assignee: Techtronic Floor Care Technology Limited, Tortola (VG)

( * ) Notice: Subject to any disclaimer, the term of this patent is extended or adjusted under 35 U.S.C. 154(b) by 623 days.

(21) Appl. No.: 13/600,525

(22) Filed: Aug. 31, 2012

(65) Prior Publication Data

US 2013/0111693 A1 May 9, 2013

Related U.S. Application Data

(60) Provisional application No. 61/530,506, filed on Sep. 2, 2011.

(51) Int. Cl.

| | |
|---|---|
| ***A47L 7/00*** | (2006.01) |
| ***A47L 11/40*** | (2006.01) |
| ***A47L 11/34*** | (2006.01) |

(52) U.S. Cl.

CPC ..... *A47L 11/4083* (2013.01); *A47L 7/0004* (2013.01); *A47L 11/34* (2013.01)

(58) Field of Classification Search

CPC .... A47L 11/4083; A47L 11/34; A47L 7/0004
USPC ..... 15/320
See application file for complete search history.

(56) References Cited

U.S. PATENT DOCUMENTS

| | | | | |
|---|---|---|---|---|
| 4,123,818 | A | | 11/1978 | Hurwitz |
| 4,464,810 | A | * | 8/1984 | Karpanty ..... 15/320 |
| 4,558,484 | A | | 12/1985 | Groth |
| 4,809,397 | A | | 3/1989 | Jacobs et al. |
| 5,099,543 | A | | 3/1992 | Wade |
| 5,289,611 | A | | 3/1994 | Yonkers et al. |
| 5,493,753 | A | | 2/1996 | Rostamo |
| 5,887,313 | A | | 3/1999 | Hanold et al. |
| 5,896,617 | A | | 4/1999 | Kasen et al. |
| 5,901,408 | A | | 5/1999 | Miller et al. |

(Continued)

OTHER PUBLICATIONS

PCT/US2012/053308 International Search Report and Written Opinion mailed on Dec. 26, 2012 (12 pages).

(Continued)

*Primary Examiner* — Bryan R Muller
(74) *Attorney, Agent, or Firm* — Michael Best & Friedrich LLP

(57) ABSTRACT

An extractor cleaning machine that includes a base movable along a surface to be cleaned, the base including a distribution nozzle and a suction nozzle. The extractor further includes a suction source in fluid communication with the suction nozzle. A recovery tank is in fluid communication with the suction source and the suction nozzle to receive the fluid drawn through the suction nozzle. The extractor further includes a supply tank including a first chamber for storing a first fluid, a second chamber for storing a second fluid, and a third chamber in fluid communication with the first chamber and the second chamber to receive the first and second fluids, the third chamber also in fluid communication with the distribution nozzle for supplying a mixture of the first and second fluids to the distribution nozzle.

13 Claims, 17 Drawing Sheets

(56) References Cited

U.S. PATENT DOCUMENTS

| | | | | |
|---|---|---|---|---|
| 5,937,475 | A | 8/1999 | Kasen et al. | |
| 6,073,300 | A | 6/2000 | Zahuranec et al. | |
| 6,138,322 | A | 10/2000 | Crouser et al. | |
| 6,158,081 | A | 12/2000 | Kasen et al. | |
| 6,167,586 | B1 | 1/2001 | Reed, Jr. et al. | |
| 6,192,548 | B1 | 2/2001 | Huffman | |
| 6,206,980 | B1 | 3/2001 | Robinson | |
| 6,279,196 | B2 * | 8/2001 | Kasen et al. | 15/320 |
| 6,481,048 | B1 | 11/2002 | Hauff et al. | |
| 6,513,188 | B2 | 2/2003 | Zahuranec et al. | |
| 6,681,442 | B2 * | 1/2004 | Coates et al. | 15/320 |
| 6,725,498 | B2 | 4/2004 | Symensma et al. | |
| 6,836,928 | B2 | 1/2005 | Zahuranec et al. | |
| 6,880,199 | B1 * | 4/2005 | Huffman et al. | 15/320 |
| 7,069,619 | B2 | 7/2006 | Bowden et al. | |
| 7,124,961 | B2 | 10/2006 | Wilting | |
| 7,269,879 | B2 * | 9/2007 | Kegg et al. | 15/320 |
| 7,331,082 | B2 | 2/2008 | Hertrick et al. | |
| 7,362,064 | B2 | 4/2008 | Coates et al. | |
| 7,475,712 | B2 | 1/2009 | McDowell | |
| 7,617,563 | B2 * | 11/2009 | Hertrick et al. | 15/320 |
| 7,673,370 | B2 | 3/2010 | Frederick et al. | |
| 2001/0002500 | A1 | 6/2001 | Kasen et al. | |
| 2002/0013975 | A1 | 2/2002 | Fulghum | |
| 2004/0187250 | A1 | 9/2004 | Leonatti et al. | |
| 2004/0226578 | A1 | 11/2004 | Guest et al. | |
| 2005/0132524 | A1 | 6/2005 | Parr | |
| 2006/0123587 | A1 | 6/2006 | Parr et al. | |
| 2006/0272120 | A1 | 12/2006 | Barrick et al. | |
| 2007/0067945 | A1 | 3/2007 | Kasper et al. | |
| 2009/0165822 | A1 | 7/2009 | Kintz et al. | |
| 2011/0094547 | A1 | 4/2011 | Ryou | |

OTHER PUBLICATIONS

Extended European Search Report for Application No. 12828848.7 dated Dec. 10, 2014 (5 pages).

Chinese Patent Office Action for Application No. 2012800468523 dated Aug. 28, 2015 (37 pages, English translation included).

* cited by examiner

SUPPLY TANK FOR AN EXTRACTOR CLEANING MACHINE

CROSS REFERENCE TO RELATED APPLICATIONS

This application claims priority to U.S. Provisional Patent Application No. 61/530,506, filed Sep. 2, 2011, the entire contents of which are hereby incorporated by reference herein.

BACKGROUND

The present invention relates to extractor cleaning machines and, more particularly, to supply tanks for extractor cleaning machines.

An extractor cleaning machine typically includes a supply tank that dispenses premixed water and detergent for cleaning a surface. Some extractor cleaning machines include two separate tanks for water and for detergent such that the water and detergent are mixed at a preset ratio within the machine. Other extractor cleaning machines include detergent tanks combined with water tanks into a single assembly. These extractor cleaning machines typically include elaborate valve and conduit arrangements to mix the water and detergent at desired ratios during operation.

SUMMARY

In one embodiment, the invention provides an extractor cleaning machine including a base movable along a surface to be cleaned, and the base includes a distribution nozzle and a suction nozzle. A suction source is in fluid communication with the suction nozzle, and the suction source is operable to draw fluid from the surface through the suction nozzle. A recovery tank is in fluid communication with the suction source and the suction nozzle to receive the fluid drawn through the suction nozzle. The extractor cleaning machine further includes a supply tank including, a first chamber for storing a first fluid, a second chamber for storing a second fluid, and a third chamber in fluid communication with the first chamber and the second chamber to receive the first and second fluids, the third chamber also in fluid communication with the distribution nozzle for supplying a mixture of the first and second fluids to the distribution nozzle.

In another embodiment, the invention provides an extractor cleaning machine including a base movable along a surface to be cleaned, and the base includes a distribution nozzle and a suction nozzle. A suction source is in fluid communication with the suction nozzle, and the suction source is operable to draw fluid from the surface through the suction nozzle. A recovery tank is in fluid communication with the suction source to receive the fluid drawn through the suction nozzle. The extractor further includes a supply tank including a first tank including a body for storing a first fluid, a second tank including a body that is at least partially defined by the body of the first tank for storing a second fluid, and a mixing chamber at least partially defined by at least one of the body of the first tank and the body of the second tank. The mixing chamber is in fluid communication with the first tank and the second tank for receiving the first and second fluids. The mixing chamber is also in fluid communication with the distribution nozzle for supplying a mixture of the first and second fluids to the distribution nozzle.

In yet another embodiment, the invention provides a supply tank for use with an extractor cleaning machine where the extractor cleaning machine includes a base having a distribution nozzle. The supply tank includes a first chamber for storing a first fluid, a second chamber for storing a second fluid, and a third chamber in fluid communication with the first chamber and the second chamber for receiving the first and second fluids. The third chamber includes an outlet configured to be in fluid communication with the distribution nozzle for supplying a mixture of the first and second fluids to the distribution nozzle. The supply tank further includes a valve operable to control the amount of second fluid being supplied from the second chamber to the third chamber. The first chamber, the second chamber, the third chamber, and the valve are configured to be removable as a single unit from the extractor cleaning machine.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
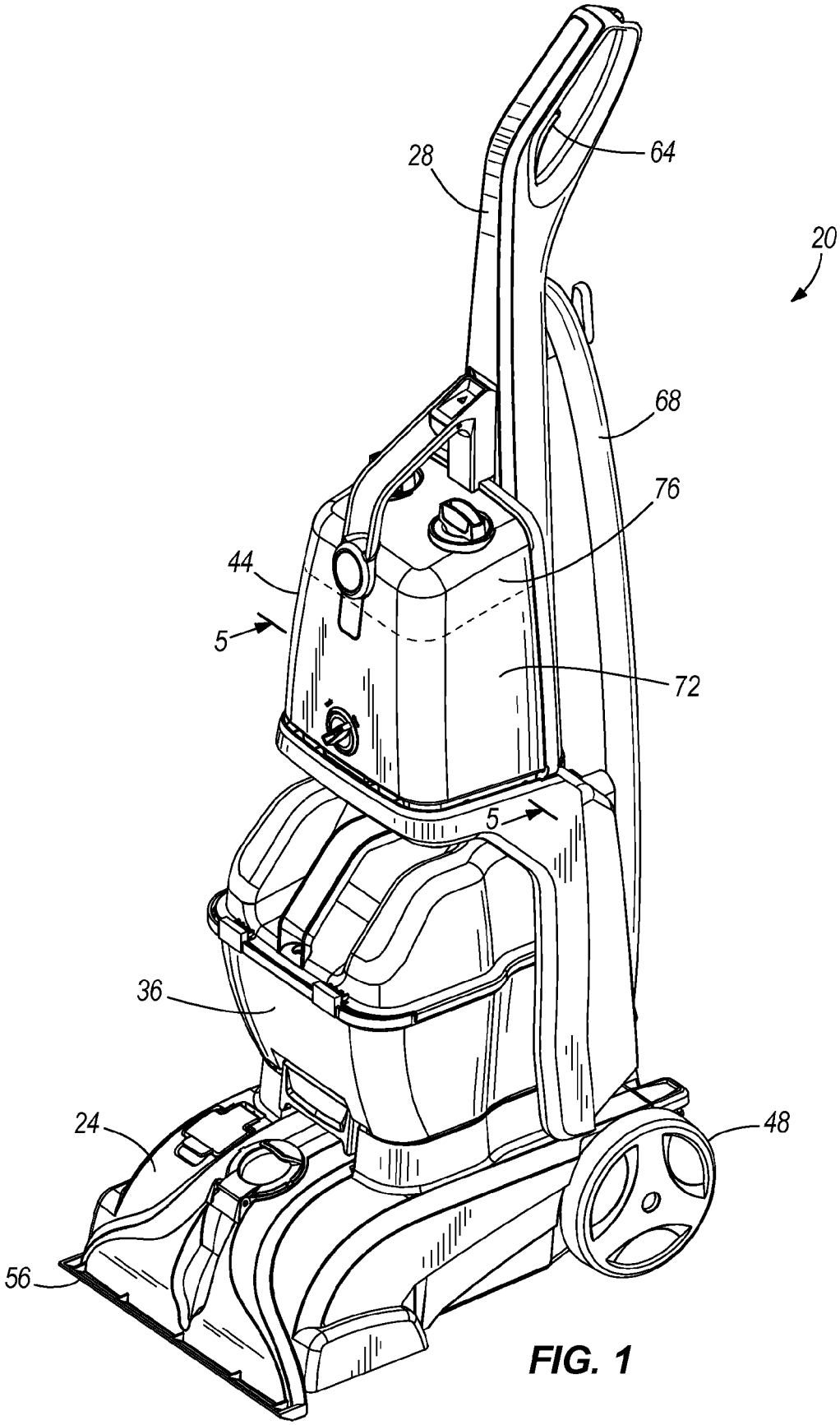
FIG. 1 is a perspective view of an extractor cleaning machine according to one embodiment of the invention.

FIG. 1 illustrates an extractor cleaning machine 20 (hereinafter referred to simply as an "extractor"). In the illustrated embodiment, the extractor 20 is an upright extractor operable to clean a surface such as, for example, a floor. In other embodiments, the extractor 20 may be, for example, a canister-type extractor, a handheld extractor, or a portable carpet cleaner. In some embodiments, the extractor 20 may be adapted to clean a variety of surfaces, such as carpets, hardwood floors, tiles, or the like. The extractor 20 distributes or sprays a cleaning fluid (e.g., water, detergent, or a mixture of water and detergent) onto the surface to clean the surface. The extractor 20 then draws the cleaning fluid and dirt off of the surface, leaving the surface relatively clean and dry.

The illustrated extractor 20 includes a body having a base or foot 24 and a handle 28 that is pivotally coupled to the base 24. A suction source is supported by the base 24, and a recovery tank 36 is coupled to the base 24. A distributor is supported by the handle 28, and a supply tank 44 is coupled to the handle 28. The base 24 is movable along the surface to be cleaned and supports the other components of the extractor 20. Two wheels 48 (only one of which is shown in FIG. 1) are coupled to the base 24 to facilitate movement of the base 24 along the surface. In the illustrated embodiment, the wheels 48 are idle wheels. In other embodiments, the wheels 48 may be driven wheels.

The base 24 includes a distribution nozzle, a suction nozzle 56, and a brush assembly. The distribution nozzle is coupled to the lower surface of the base 24 to direct cleaning fluid toward the surface. The suction nozzle 56 is also coupled to the base 24 to draw fluid and dirt from the surface back into the recovery tank 36. The brush assembly is coupled to the lower surface of the base 24 adjacent the nozzle 56 to scrub the surface. In some embodiments, the brush assembly may be electrically or pneumatically rotated to agitate and scrub the surface.

The illustrated handle 28 is pivotally coupled to and extends from the base 24. The handle 28 is pivotable or tiltable relative to the base 24 from the generally vertical storage position shown in FIG. 1 to an infinite number of generally non-vertical inclined operating positions. Pivoting the handle 28 to an operating position facilitates moving the base 24 along the surface. When the handle 28 is in the upright position, the supply tank 44 is above and over the recovery tank 36. The handle 28 supports a trigger 64 that is actuatable to spray cleaning fluid from the supply tank 44 through the distribution nozzle and onto the surface. The handle 28 also supports an accessory hose 68 that is connectable to a variety of hand-held tools.

The suction source is in fluid communication with the suction nozzle 56 to draw fluid and dirt from the surface through the nozzle 56. In some embodiments, the suction source includes an electric motor that rotates a fan to generate a vacuum to draw the fluid and dirt through the nozzle 56.

The recovery tank 36 is in fluid communication with the suction source and the suction nozzle 56 to receive and store the fluid and dirt drawn through the nozzle 56. The illustrated recovery tank 36 is removably coupled to and supported by the base 24. In other embodiments, the recovery tank 36 may be supported by the handle 28.

The distributor is in fluid communication with the distribution nozzle and transports cleaning fluid from the supply tank 44 to the surface through the distribution nozzle. In some embodiments, the distributor may include a pump, a valve, and conduits connecting the supply tank 44, the valve, and the pump to transport and control the flow of cleaning fluid to the distribution nozzle. In some embodiments, the distributor may not include the pump such that cleaning fluid is gravity-fed from the supply tank 44 to the distribution nozzle.

The supply tank 44 includes a first tank 72 for storing a first cleaning fluid (e.g., water) and a second tank 76 above the first tank 72 for storing a second cleaning fluid (e.g., detergent). In other embodiments, the relative positions of the first tank 72 and the second tank 76 may be reversed. In the illustrated embodiment, the supply tank 44 is supported on the handle 28 to supply the cleaning fluids to the distribution nozzle. The supply tank 44 is removable from the handle 28 to facilitate filling or emptying the tanks 72, 76. In other embodiments, the supply tank 44 may be supported on the base 24.

Figure 2:
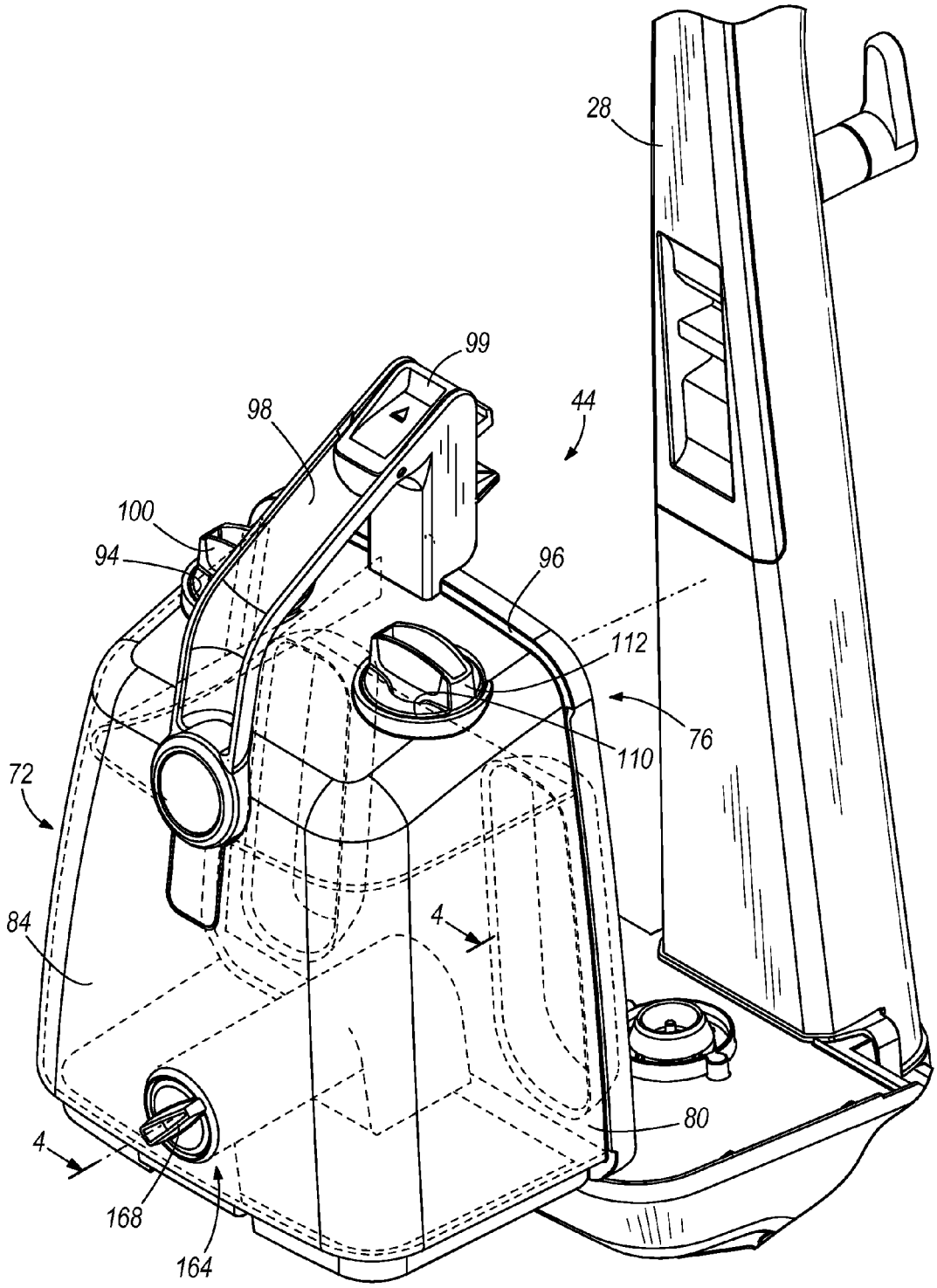
FIG. 2 is a partially exploded view of the extractor cleaning machine shown in FIG. 1.
Figure 3:
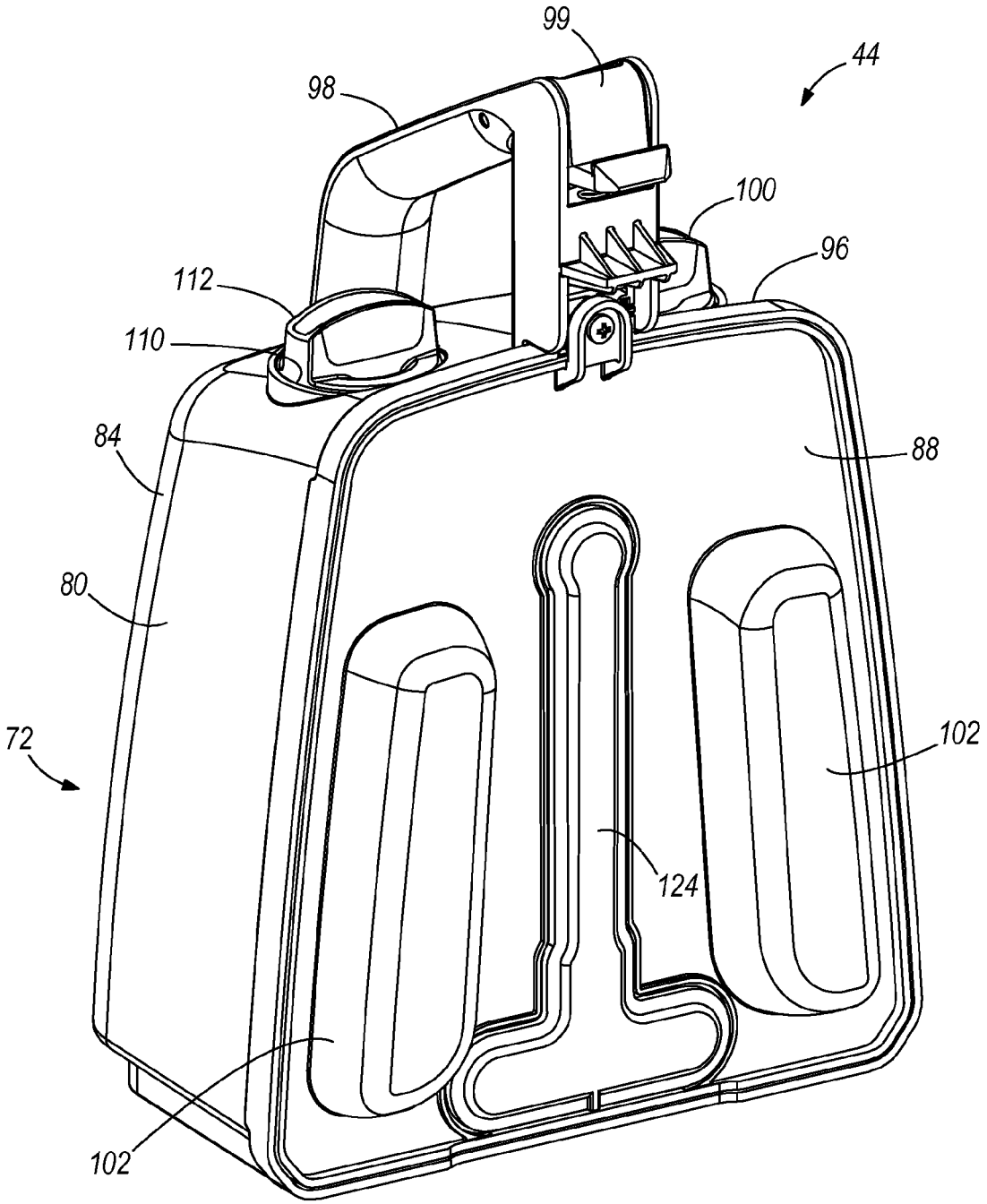
FIG. 3 is a rear perspective view of a supply tank of the extractor cleaning machine of FIG. 1.
Figure 4:
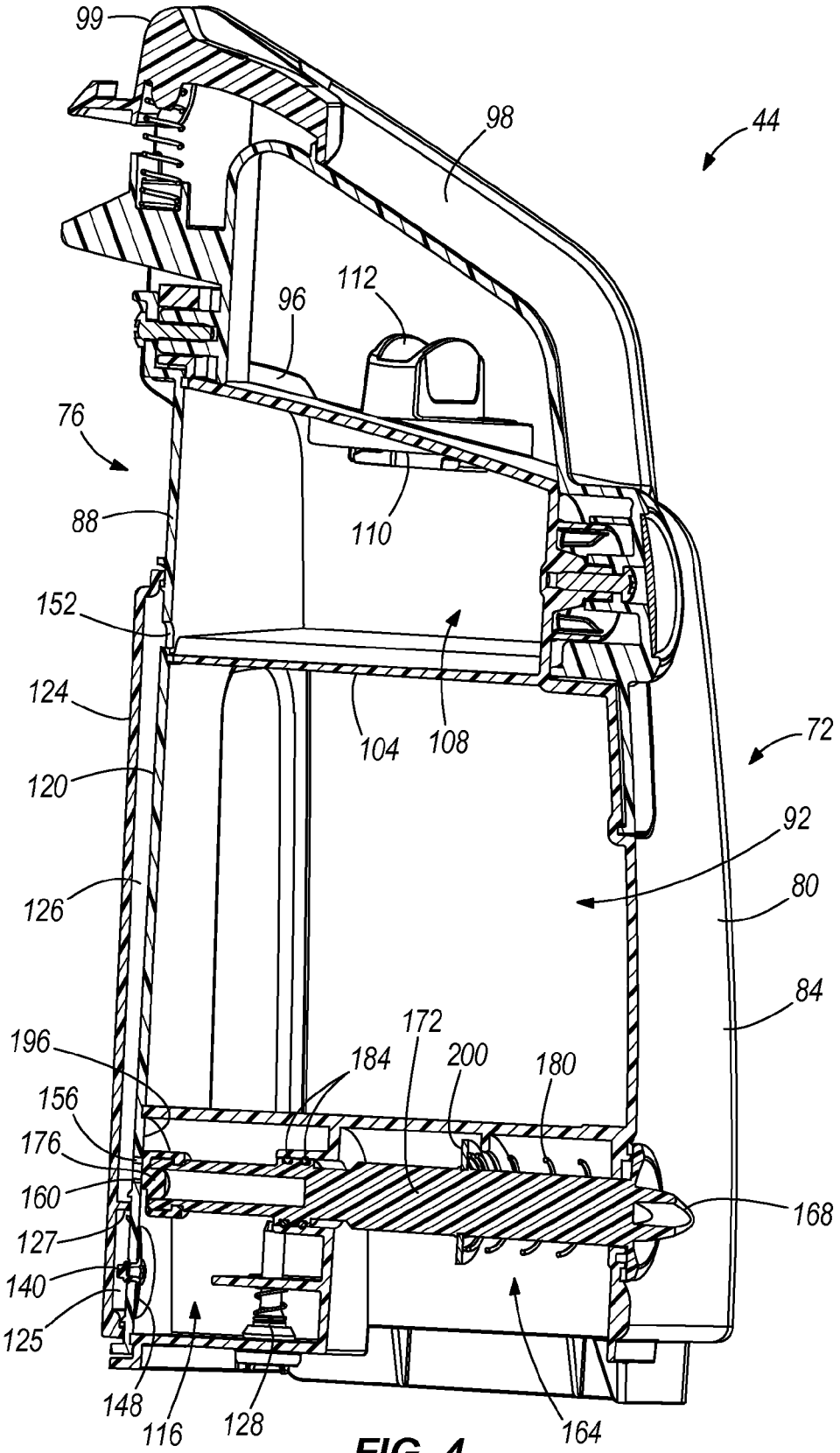
FIG. 4 is a cross-sectional view of the supply tank taken along lines 4-4 of FIG. 2.

As shown in FIGS. 2-4, the first tank 72 includes a body 80 having a front body portion 84 and a rear body portion 88. The front and rear body portions 84, 88 are coupled together to define a first chamber 92 (FIG. 4) for storing the first cleaning fluid. In the illustrated embodiment, the front body portion 84 is blow molded and the rear body portion 88 is coupled to the front body portion 84 with screws. In other embodiments, the rear body portion 88 may be connected to the front body portion 84 by welding, glue, snaps, or geometric features (e.g., dovetail joints). A first inlet aperture 94 is formed in an upper surface 96 of the body 80 for filling the first tank 72. The first inlet aperture 94 is covered by a first cap 100 to allow selective access to the first chamber 92. A handle 98 is coupled to and extends from the front body portion 84. The illustrated handle 98 includes a latching mechanism 99 to releasably secure the supply tank 44 to the extractor 20.

In the illustrated embodiment, the rear body portion 88 includes two projected areas 102. In other embodiments, the rear body portion 88 may include fewer or more projected areas. When the tank 44 is coupled to the handle 28, the handle 28 is located between the projected areas 102 and the projected areas 102 and the handle 28 provide a locating feature that helps the user locate the proper position of the tank 44 to couple the tank 44 to the handle 28. The projected areas 102 extend outwardly from the supply tank 44 to increase the capacity (e.g., volume) of the first chamber 92. During manufacture, the sizes of the projected areas 102 may be increased or decreased depending on the desired capacity of the first chamber 92. Adjusting the sizes of the projected areas 102 on the rear body portion 88 allows the capacity of the first chamber 92 to be easily changed while maintaining the industrial design of the supply tank 44 (i.e., without altering the appearance of the visible portions of the supply tank 44 when the tank 44 is connected to the extractor 20).

Figure 5:
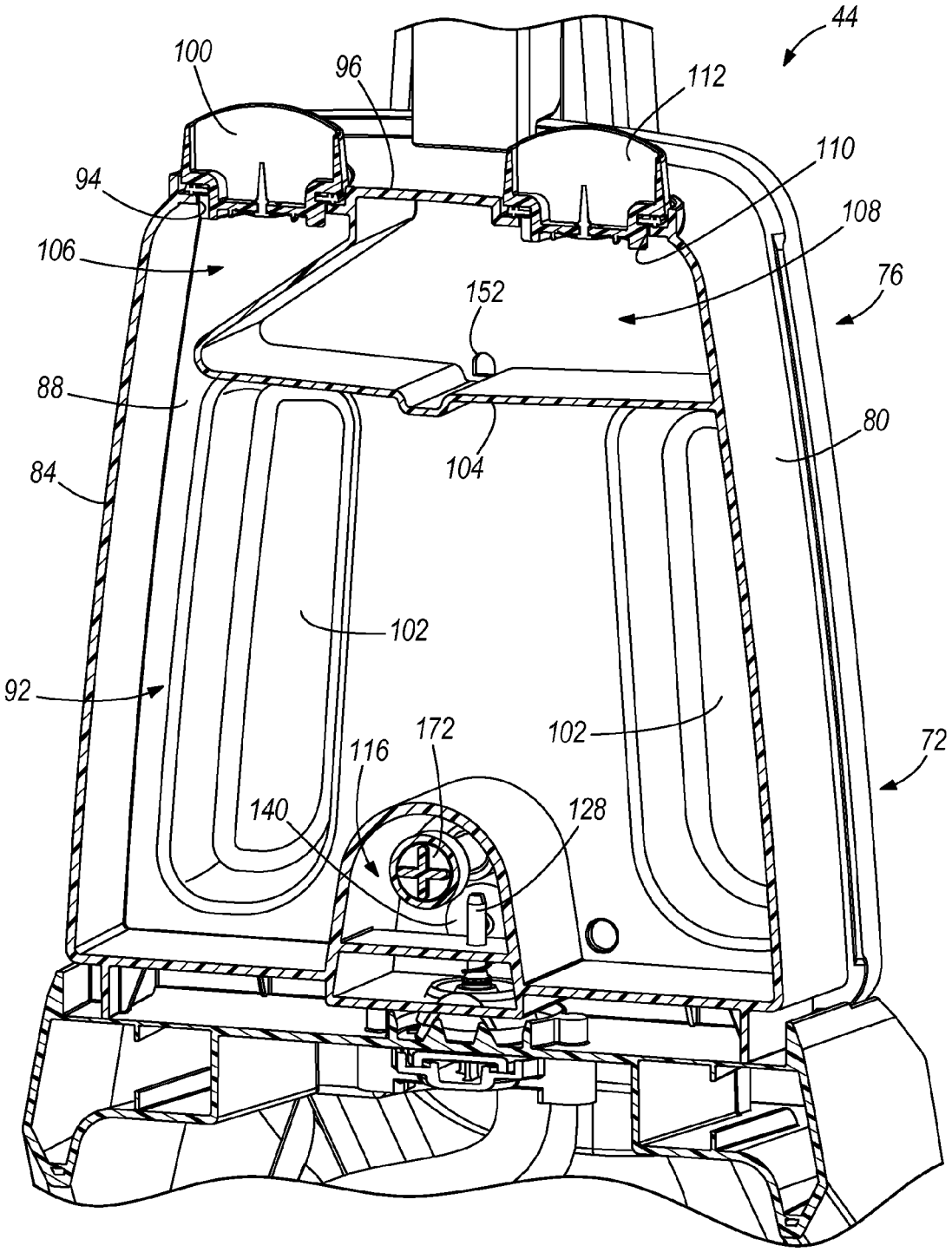
FIG. 5 is another cross-sectional view of the supply tank taken along lines 5-5 of FIG. 1.

The second tank 76 is coupled to and supported by the first tank 72 such that the first tank 72 and the second tank 76 are removable from the handle 28 as a single unit. In the illustrated embodiment, the second tank 76 is positioned within the first tank 72 such that the supply tank 44 is a tank-in-tank design that separates the second cleaning fluid from the first cleaning fluid. As shown in FIGS. 4 and 5, the second tank 76 is formed by a portion of the front body portion 84, a portion of the rear body portion 88, and an inner wall 104 extending through the body 80. The inner wall 104 does not extend entirely across the body 80, but instead extends to the upper surface 96 to define a relatively small fill neck 106 for filling the first chamber 92 of the first tank 72 through the first inlet aperture 94. The rear body portion 88 is removable from the front body portion 84 to facilitate positioning and manufacturing the second tank 76 within the first tank 72. The front body portion 84, the rear body portion 88, and the inner wall 104 together define a second chamber 108 for storing the second cleaning fluid. In other embodiments, the second tank 76 may be discrete from, yet permanently coupled or fixed to the body 80 of the first tank 72. In still other embodiments, the second tank 76 may snap-fit into the first tank 70, or otherwise releasably coupled to by latches, snaps, or fasteners. A second inlet aperture 110 is formed in the upper surface 96 of the body 80 for filling the second tank 76. The second inlet aperture 110 is covered by a second cap 112 to allow selective access to the second chamber 108.

As shown in FIGS. 4-5, the front and rear body portions 84, 88 also define a mixing chamber 116 in a lower portion of the body 80 below and toward the rear of the first and second chambers 92, 108 such that the mixing chamber 116 remains at a lowest point of the tank 44 when a user reclines the handle 28. The first and second chambers 92, 108 are in fluid communication with the mixing chamber 116 via a T-shaped recess or groove 120 (FIG. 7) formed in the rear body portion 88. In other embodiments, the chambers 92, 108 may be in fluid communication with the mixing chamber 116 via a tube or conduit. In the illustrated embodiment, a cover 124 is coupled to the rear body portion 88 to substantially cover the T-shaped recess 120 and define two channels 125, 126 (FIG. 4) for fluid flow. The channels 125, 126 are separated by a dividing wall 127 that extends from the cover 124 to the rear body portion 88. The mixing chamber 116 is in fluid communication with the distributor and the distribution nozzle via an outlet aperture. An outlet valve 128 is coupled to the outlet aperture to selectively allow fluid flow out of the mixing chamber 116. In the illustrated embodiment, the outlet valve 128 is a poppet valve that is automatically opened when the supply tank 44 is connected to the extractor 20 and automatically closes when the supply tank 44 is removed. In other embodiments, other suitable valves may also or alternatively be employed. The illustrated outlet aperture and valve 128 are located at a lowest point toward a rear of the supply tank 44 to facilitate emptying or draining the mixing chamber 116 when the handle 28 (FIG. 1) is in a non-vertical, use position. A breather tube may extend from the mixing chamber 116 to a top of the supply tank 44 to evacuate air out of the mixing chamber 116.

Figure 6:
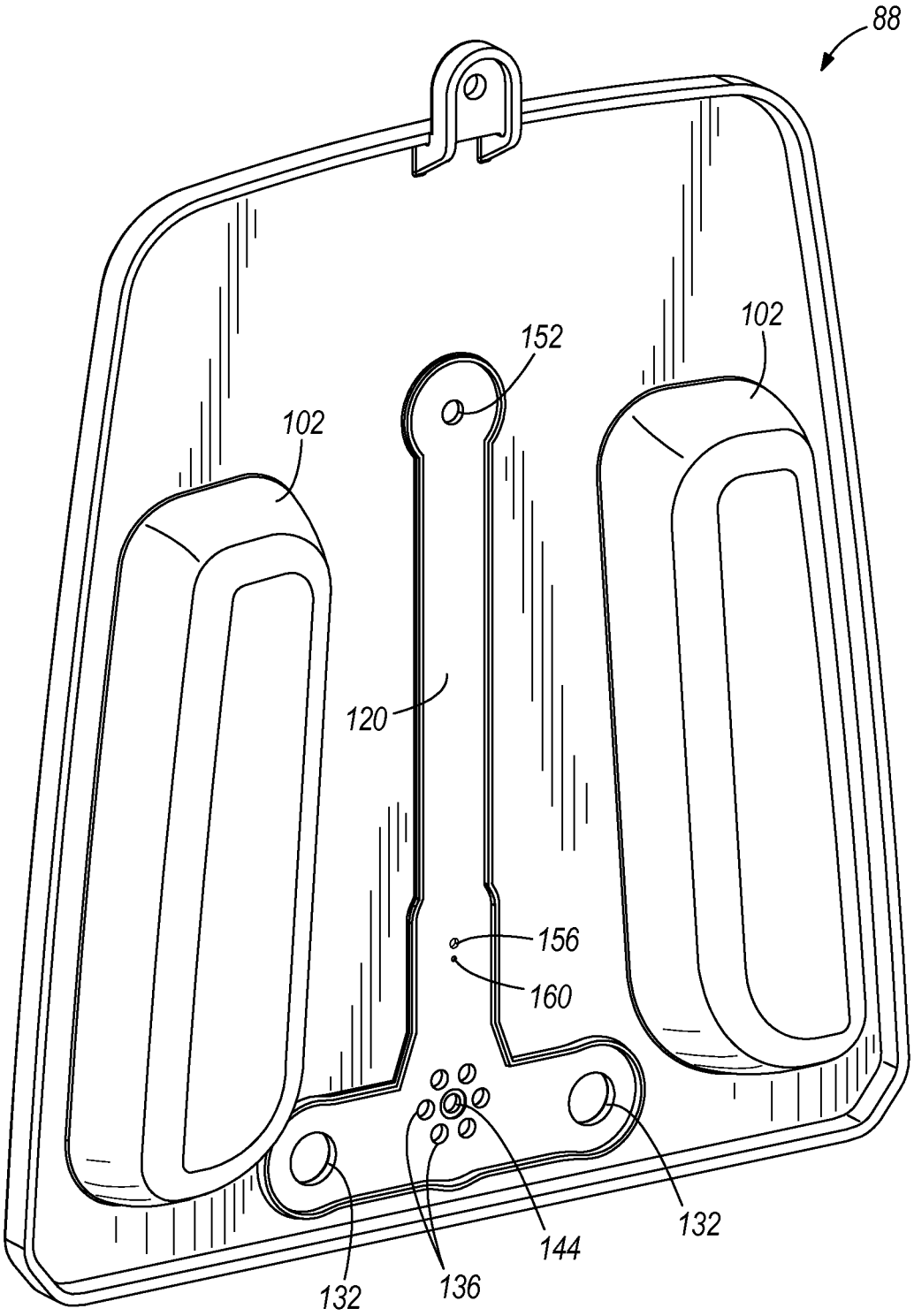
FIG. 6 is a perspective view of a rear body portion of the supply tank.

Referring to FIGS. 4 and 6, the first chamber 92 is in fluid communication with the first channel 125 of the T-shaped recess 120 via two outlets 132 formed in the rear body portion 88. The outlets 132 are formed near a bottom of the chamber 92 to facilitate draining when the handle 28 (FIG. 1) is in a non-vertical, use position. A plurality of inlets 136 is also formed in a circular pattern on the rear body portion 88 such that the first channel 125 communicates with the mixing chamber 116. The first cleaning fluid can thereby flow out of the first chamber 92 through the outlets 132, through the first channel 125 on the rear body portion 88, and into the mixing chamber 116 through the inlets 136.

As shown in FIGS. 4 and 5, a check valve 140 is coupled to the rear body portion 88 and covers the inlets 136. The check valve 140 allows fluid to flow from the first channel 125 into the mixing chamber 116, but inhibits fluid from flowing back out of the mixing chamber 116 into the first channel 125. In the illustrated embodiment, the check valve 140 is an umbrella valve that mounts to a central aperture 144 (FIG. 6) formed in the rear body portion 88 in the center of the inlets 136. The check valve 140 includes an elastomeric head 148 that covers the inlets 136 and is deflectable to allow fluid flow into the mixing chamber 116. In other embodiments, other suitable check valves may also or alternatively be employed. In addition, the inlets 136 may be formed in other patterns or the rear body portion 88 may only include a single inlet.

Referring back to FIGS. 4 and 6, the second chamber 108 is in fluid communication with the second channel 126 of the T-shaped recess 120 via an outlet 152 formed in the rear body portion 88. The outlet 152 is formed near a bottom of the second chamber 108 to facilitate maximum draining when the handle 28 (FIG. 1) is in a non-vertical, use position. A relatively large-diameter inlet 156 and a relatively small-diameter inlet 160 are also formed in the rear body portion 88 such that the second channel 126 is in fluid communication with the mixing chamber 116. Although in the illustrated embodiment the inlets 156, 160 are circular, in other embodiments the inlets can have other suitable shapes and/or sizes. The second cleaning fluid can thereby flow out of the second chamber 108 through the outlet 152, through the second channel 126 on the rear body portion 88, and into the mixing chamber 116 through either or both of the inlets 156, 160.

In the illustrated embodiment, the second tank 76 is positioned in an upper portion of the body 80 so that the second chamber 108 is located generally above the first chamber 92 and the mixing chamber 116. Therefore, the fluid level within the second chamber is above the fluid level in the first chamber 92 even when the handle 28 is in a reclined position relative to the base 24. Such an arrangement inhibits cross-mixing of fluid between the tanks 72, 76. That is, by positioning the second chamber 108 above the first chamber 92 and the mixing chamber 116, cleaning fluid within the mixing chamber 116 and water within the first chamber 92 are generally inhibited from flowing back into the second chamber 108 when the extractor 20 is not in operation. In addition, the geometry of the inner wall 104 and the fill neck 106 (FIG. 5) limits the volume of fluid that could be located above the second chamber 108 if the first chamber 92 were completely filled. Cross-flow in the opposite direction (i.e., from the second chamber 108, through the mixing chamber 116, and into the first chamber 92) is inhibited by the check valve 140. In other embodiments, the tanks 72, 76 may be positioned at relatively the same height, and the supply tank 44 may include multiple check valves to inhibit cross-flow between the tanks 72, 76.

As shown in FIGS. 4-6, the supply tank 44 also includes a valve assembly 164 coupled to the body 80 of the first tank 72 and extending into the mixing chamber 116. The valve assembly 164 allows a user to adjust the amount (i.e., flow rate) of second cleaning fluid being supplied from the second tank 76 to the mixing chamber 116 and, ultimately, the distribution nozzle. By adjusting the flow rate of the second cleaning fluid, a user can change the ratio (i.e., concentration) of detergent to water being distributed onto a surface. In the illustrated embodiment, the valve assembly 164 is mounted to and supported by the first tank 72 such that the entire supply tank 44 (e.g., the first tank 72, the second tank 76, and the valve assembly 164) is removable as a single unit from the extractor 20.

The illustrated valve assembly 164 includes an actuator 168, an elongated shaft 172, a sealing member 176, and a biasing member 180. The actuator 168 extends from the front body portion 84 of the first tank 72 and is manually rotatable by the user. The elongated shaft 172 extends from the actuator 168 and through the mixing chamber 116 toward the rear body portion 88 of the first tank 72. Annular seals 184 (e.g., O-rings) are positioned about a portion of the shaft 172 to inhibit fluid leakage out of the mixing chamber 116.

Figure 7:
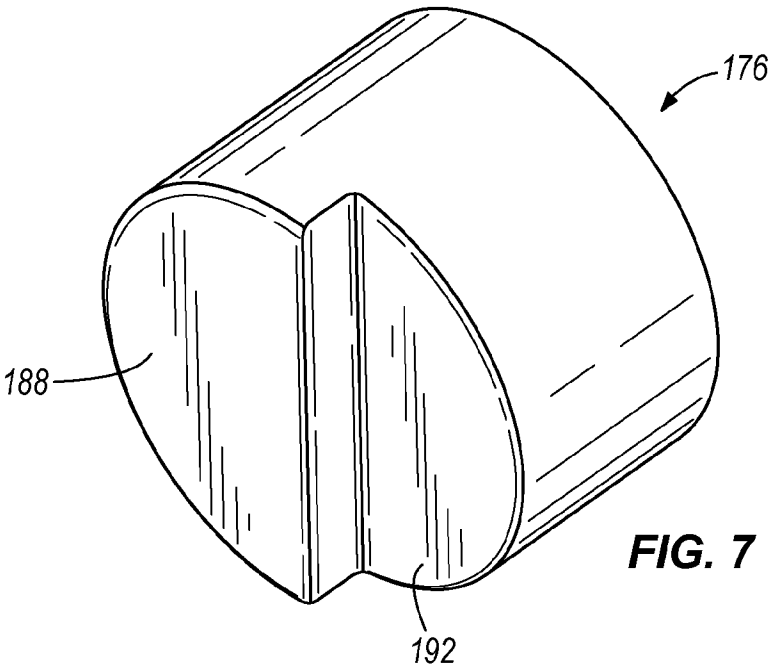
FIG. 7 is a perspective view of a sealing member of the supply tank.

The sealing member 176 is coupled to an end of the elongated shaft 172 opposite the actuator 168. As shown in FIG. 7, the sealing member 176 is formed of an elastomeric material and includes a planar portion 188 and a recessed portion 192. The planar portion 188 engages an inner surface 196 of the rear body portion 88 to selectively block the large-diameter inlet 156 and the small-diameter inlet 160. The recessed portion 192 is spaced apart from the inner surface 196 of the rear body portion 88 to selectively allow fluid flow through the inlets 156, 160 when the planar portion 188 does not cover the inlets 156, 160.

Referring back to FIGS. 4-6, the biasing member 180 extends between the front body portion 84 and a flange 200 mounted to the shaft 172. The biasing member 180 biases the shaft 172 toward the rear body portion 84 to maintain the planar portion 188 of the sealing member 176 in constant engagement with the rear body portion 88. In the illustrated embodiment, the biasing member 180 is a coil spring. In other embodiments, other suitable biasing members may also or alternatively be employed.

In operation, the sealing member 176 selectively blocks the large-diameter inlet 156 and/or the small-diameter inlet 160 to meter the flow rate of the second cleaning fluid that flows into the mixing chamber 116 via gravity. In the illustrated embodiment, the valve assembly 164 has three positions corresponding to three mixing ratios of first cleaning solution to second cleaning solution. A user can switch the valve assembly 164 between the positions by rotating the actuator 168 to change the orientation of the sealing member 176 relative to the inlets 156, 160. In other embodiments, the valve assembly 164 may have fewer or more positions corresponding to different mixing ratios. In the first position (i.e., a super wash or spot wash position), the small-diameter inlet 160 (FIG. 7) is blocked by the sealing member 176 and the large-diameter inlet 156 (FIG. 7) is unblocked such that a relatively large amount of second cleaning fluid can flow into the mixing chamber 116. In the second position (i.e., a regular wash position), the large-diameter inlet 156 is blocked by the sealing member 176 and the small-diameter inlet 160 is unblocked such that a smaller amount of second cleaning fluid can flow into the mixing chamber 116. In the third position (i.e., a rinse position), both of the inlets 156, 160 are blocked by the sealing member 176 such that the second cleaning fluid cannot flow into the mixing chamber 116. In other embodiments the tank can include another outlet directly from the first chamber 92 (i.e., fluid from the first chamber 92 does not travel through the mixing chamber 116) so that the extractor 20 can be used in a rinse mode without operating the valve 164.

In other embodiments, the rear body portion 88 may only include a single inlet that allows the second cleaning fluid to flow into the mixing chamber 116. In such embodiments, the valve assembly 164 may be operable to selectively block or unblock the single inlet to change the extractor 20 between a wash mode and a rinse mode. Alternatively, the valve assembly 164 may selectively block or unblock a portion of the single inlet to meter the amount of second cleaning fluid flowing into the mixing chamber 116. In such embodiments, a user may adjust the concentration of second cleaning fluid being discharged onto a surface by rotating the actuator 168 only a small degree. In still other embodiments, both of the inlets 156, 160 could have generally the same diameter, and the sealing member 176 could selectively block both inlets, one inlet, or neither inlet to control the flow rate.

By positioning the valve assembly 164 directly on the supply tank 44, the supply tank 44 can be easily interchanged with a premixed water and detergent supply tank that includes only a single fluid chamber. That is, like a premixed supply tank, the illustrated supply tank 44 only includes a single outlet (e.g., the outlet aperture covered by the outlet valve 128) that communicates with the distributor and the distribution nozzle of the extractor 20. Additional valves and conduits are therefore not needed inside the extractor 20 to mix the cleaning solutions of a two-tank assembly to a desired ratio. Therefore, the manufacturer can produce substantially the same extractor and switch only the tank 44 with a premixed-style tank depending on the type of extractor being supplied to the customer. Furthermore, the illustrated supply tank 44 maintains the first cleaning fluid and the second cleaning fluid in separate chambers 92, 108. Such an arrangement allows a user to easily adjust the detergent concentration being distributed onto a surface for different cleaning situations.

Figure 8:
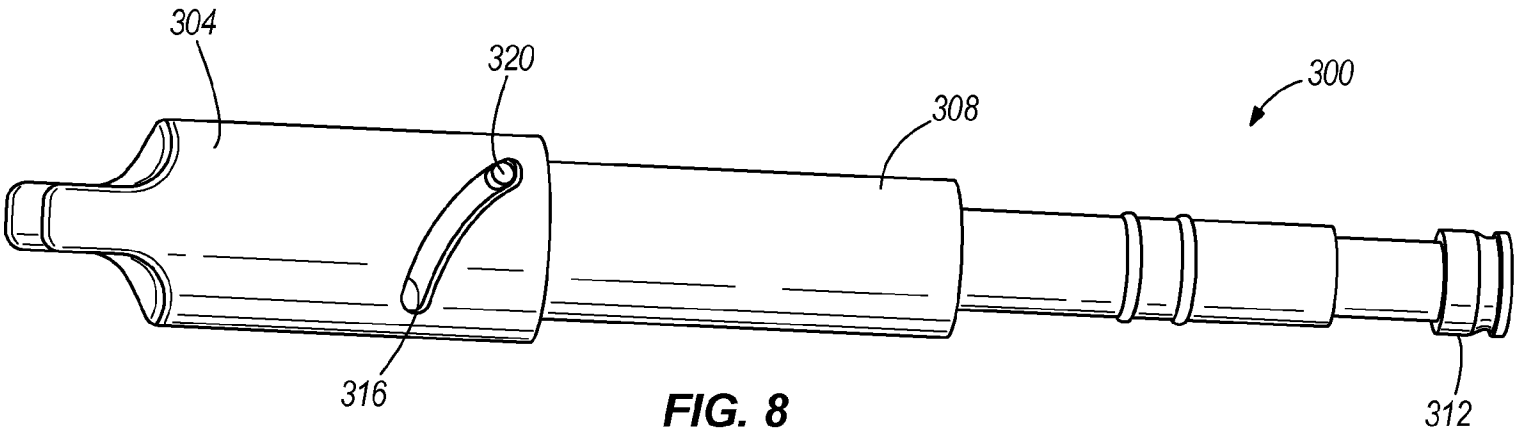
FIG. 8 illustrates a valve assembly for use with a supply tank according to another embodiment of the invention.

FIG. 8 illustrates another embodiment of a valve assembly 300 for use with the supply tank 44. The illustrated valve assembly 300 includes an actuator 304, an elongated shaft 308, and a sealing member 312. In the illustrated embodiment, the actuator 304 defines a slot 316 and the elongated shaft 308 includes a projection 320 extending into the slot 316. The slot 316 and the projection 320 provide a cam mechanism that moves the elongated shaft 308 and the sealing member 312 axially relative to the supply tank 44 when the actuator 304 is rotated. As the shaft 308 moves axially, the sealing member 312 blocks or unblocks an inlet in the rear body portion 88 to inhibit or allow the second cleaning fluid to flow into the mixing chamber 116. In some embodiments, the valve assembly 300 can also control the mix ratio by selectively allowing flow through one or more inlets in the rear body portion 88.

Figure 9:
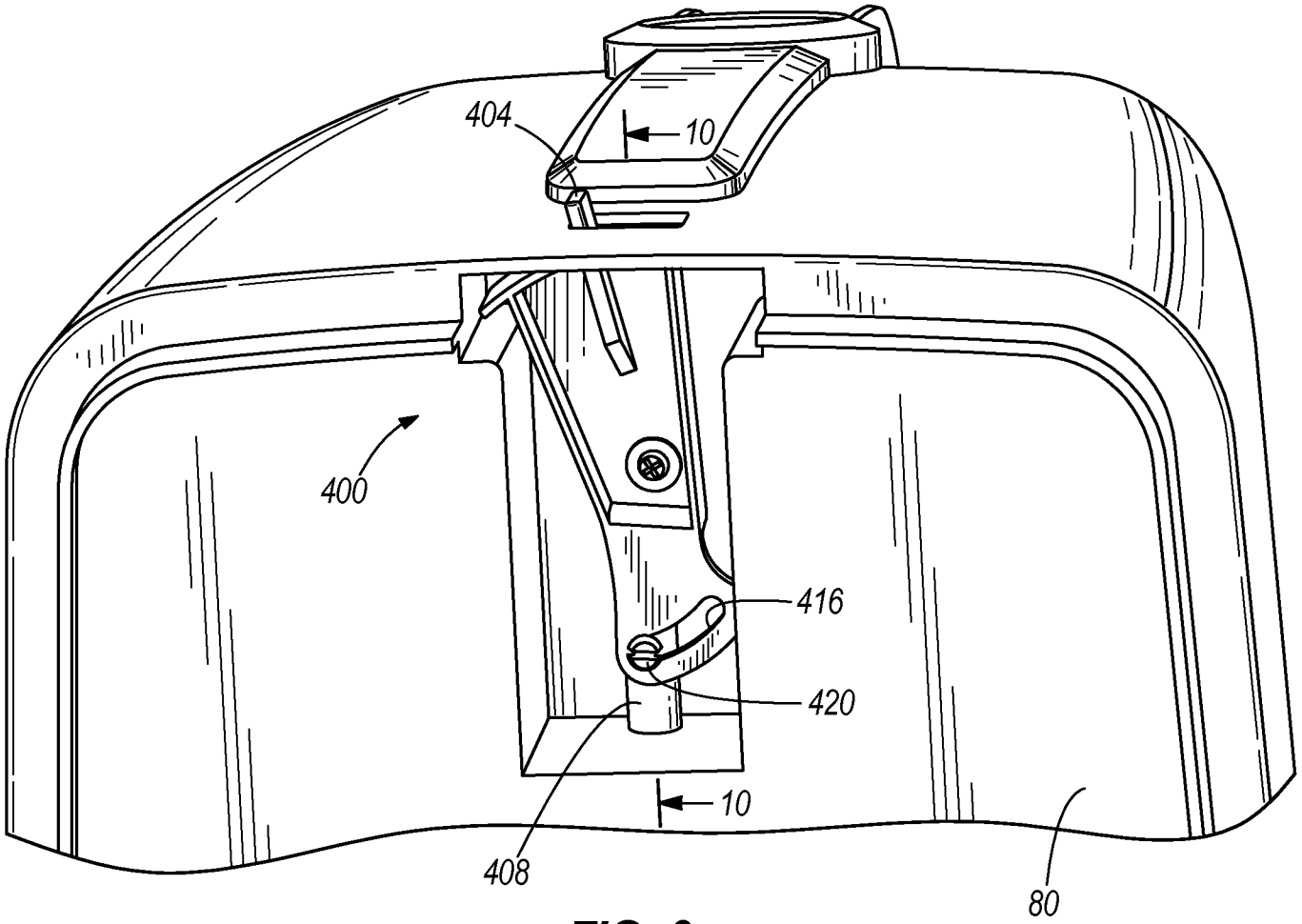
FIG. 9 illustrates a valve assembly for use with a supply tank according to another embodiment.
Figure 10:
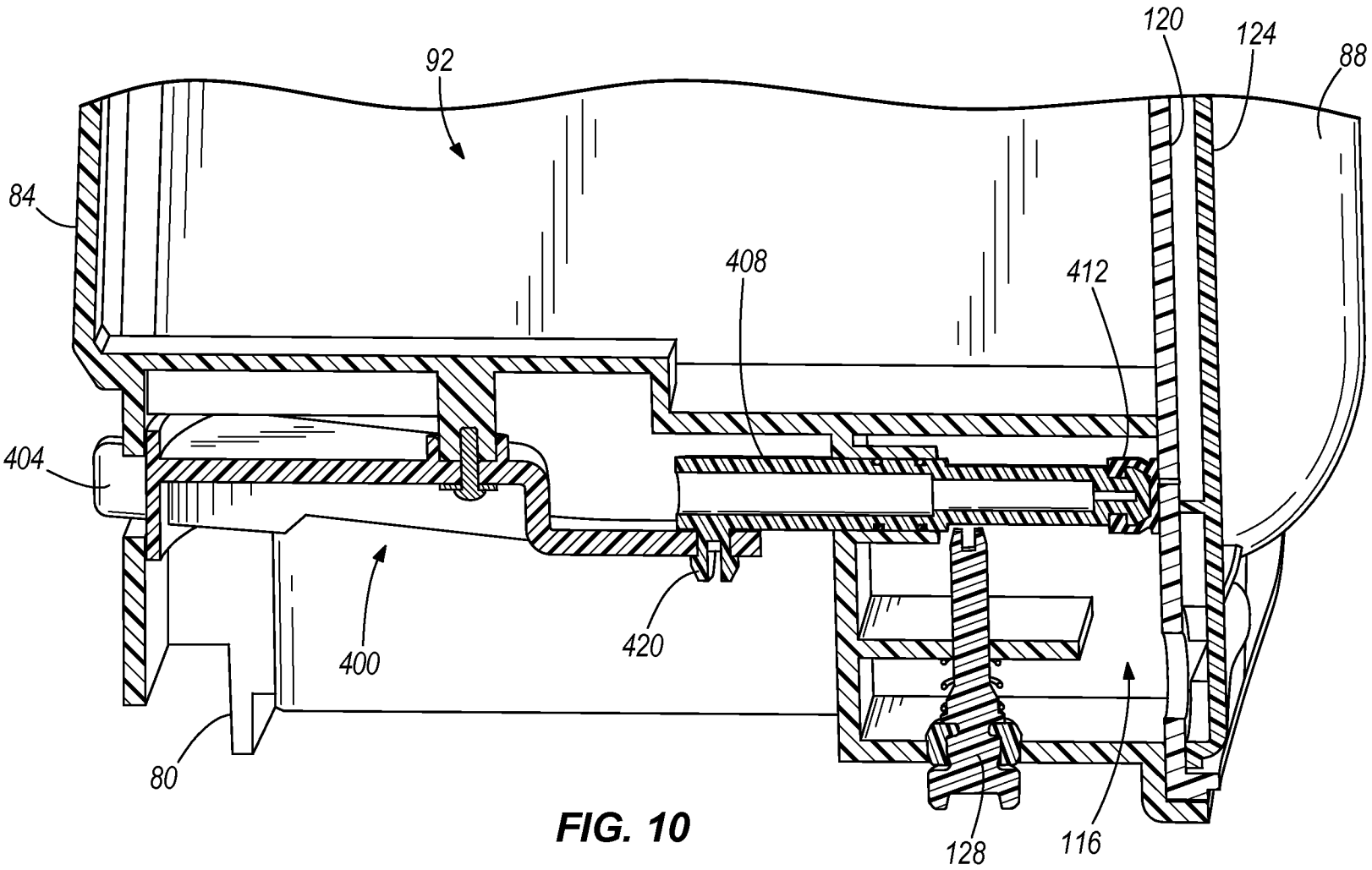
FIG. 10 is a cross-sectional view of the valve assembly of FIG. 10.

FIGS. 9 and 10 illustrate yet another embodiment of a valve assembly 400 for use with the supply tank 44. Similar to the valve assembly 300 of FIG. 9, the illustrated valve assembly 400 includes an actuator 404, an elongated shaft 408, and a sealing member 412. In the illustrated embodiment, the actuator 404 is a pivotable lever that is coupled to the shaft 408 via a slot 416 and a projection 420. The slot 416 and the projection 420 provide a cam mechanism that moves the elongated shaft 408 and the sealing member 412 axially relative to the supply tank 44 when the actuator 404 is pivoted. As the shaft 408 moves axially, the sealing member 412 blocks or unblocks an inlet in the rear body portion 88 to inhibit or allow the second cleaning fluid to flow into the mixing chamber 116.

Figure 11:
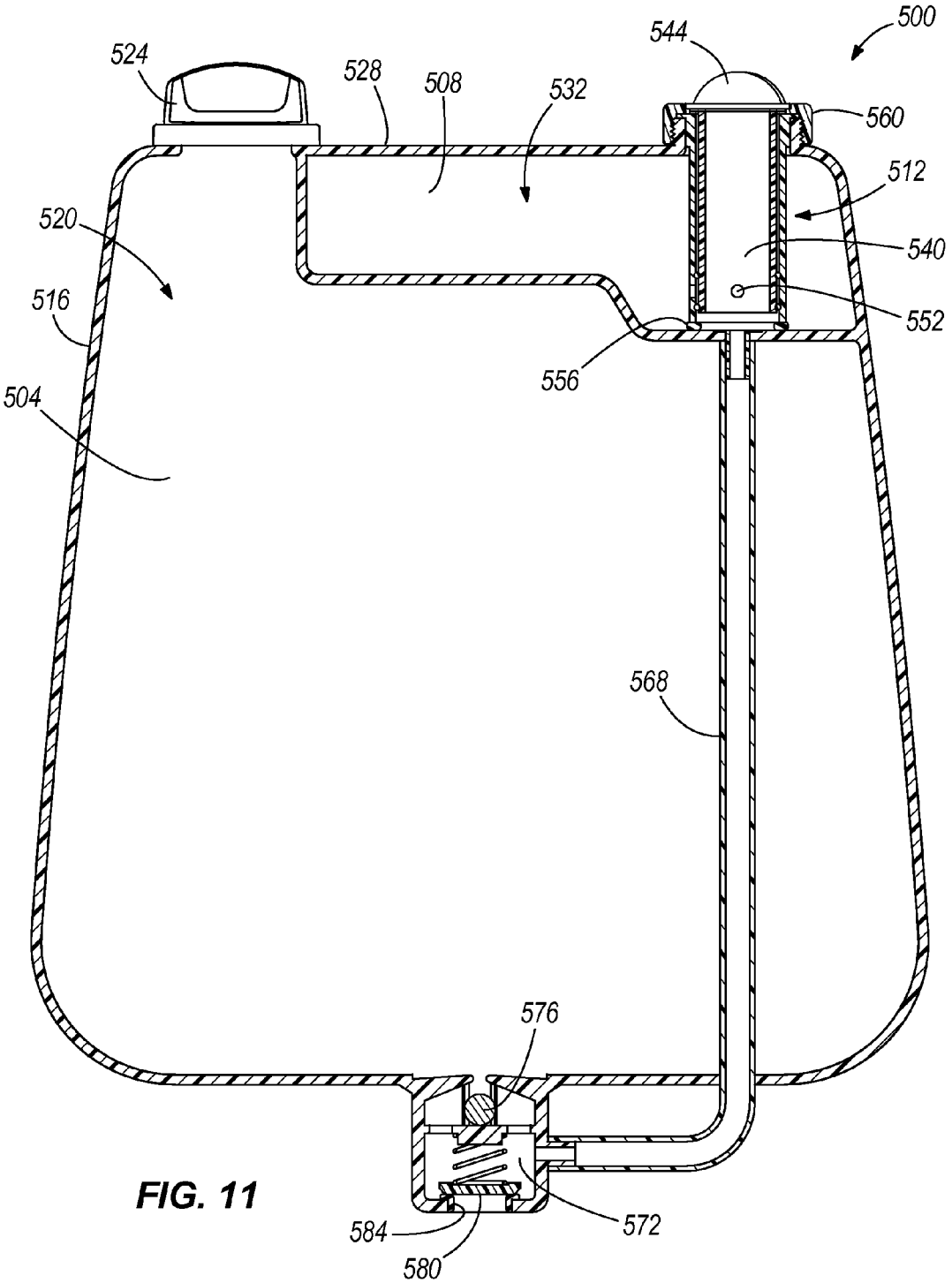
FIG. 11 illustrates another embodiment of a supply tank for use with the extractor cleaning machine shown in FIG. 1.

FIG. 11 illustrates another embodiment of a supply tank assembly 500 for use with the extractor 20. The illustrated supply tank assembly 500 includes a first tank 504, a second tank 508, and a valve assembly 512. The first tank 504 includes a body 516 that defines a first chamber 520 for storing a first cleaning fluid. A first cap 524 is coupled to an upper surface of the first tank 504 to allow selective access to the first chamber 520 through an inlet aperture. The second tank 508 includes a body 528 that defines a second chamber 532 for storing a second cleaning fluid. In the illustrated embodiment, the body 516 of the first tank 504 and the body 528 of the second tank 508 are two discrete bodies that are securely or releasably coupled together. In other embodiments, the first tank 504 and the second tank 508 may be integrally formed as a single piece such that a portion of the body 516 of the first tank 504 defines the second tank 508.

Figure 12:
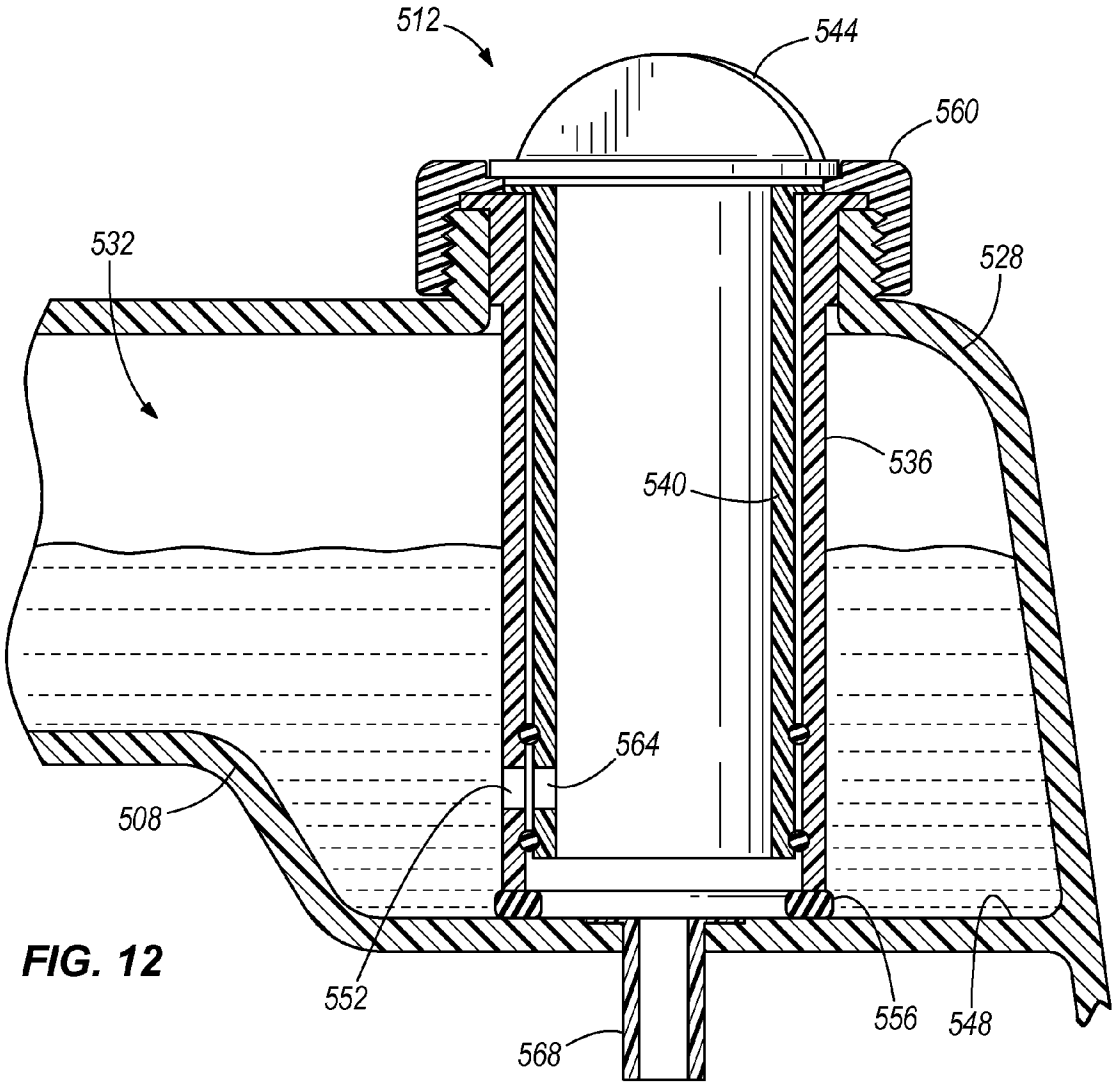
FIG. 12 illustrates a valve assembly of the supply tank of FIG. 11.

As shown in FIGS. 11 and 12, the valve assembly 512 extends through the second tank 508 and is supported by the body 516 of the first tank 504. The illustrated valve assembly 512 includes an outer tube 536 (FIG. 13), an inner tube 540, and an actuator 544. The outer tube 540 extends to a bottom surface 548 of the body 528 of the second tank 508 and defines an opening 552 near the bottom surface 548. In the illustrated embodiment, a gasket 556 is positioned between the outer tube 540 and the bottom surface 548 to inhibit fluid leakage from the second tank 508. A sleeve nut 560 is coupled to an upper end of the outer tube 536 to secure the outer tube 536 to the body 528 of the second tank 508. In the illustrated embodiment, the sleeve nut 560 may be loosened and the valve assembly 512 may be temporarily removed to refill the second tank 508.

The inner, or selector, tube 540 is positioned substantially within the outer tube 536 and defines a cross-hole 564 at substantially the same height as the opening 552 in the outer tube 536. The inner tube 540 is rotatable relative to the outer tube 536 to selectively move the cross-hole 564 into and out of fluid communication with the opening 552. When the cross-hole 564 and the opening 552 are aligned, the second cleaning fluid stored within the second chamber 532 can flow into the inner tube 540 through the cross-hole 564 to a fluid conduit 568. The fluid conduit 568 extends from the second tank 508 to a mixing chamber 572 positioned in a lower portion of the first tank 504. In some embodiments, the fluid conduit 568 may extend through the first chamber 520. In other embodiments, the fluid conduit 568 may be coupled to or formed on an outer surface of the first tank 504. When the cross-hole 564 and the opening 552 are not aligned, the inner tube 540 blocks the second cleaning fluid from flowing out of the second tank 508.

The actuator 544 is coupled to an upper portion of the inner tube 540 to rotate the inner tube 540 relative to the outer tube 536. In the illustrated embodiment, the actuator 544 is a dial that is manually rotatable by a user. In other embodiments, other suitable actuators may also or alternatively be employed.

Referring to FIG. 11, the mixing chamber 572 is also in fluid communication with the first chamber via a check valve 576. The check valve 576 permits fluid to flow from the first chamber 520 into the mixing chamber 572, but inhibits fluid flow back into the first chamber 520. In the illustrated embodiment, the supply tank assembly 500 also includes a mushroom, or poppet, valve 580. The valve 580 is coupled to an outlet aperture of the mixing chamber 572 to selectively allow fluid flow out of the mixing chamber 572. The valve 580 is automatically opened when the supply tank assembly 500 is connected to the extractor 20 and is automatically closed when the supply tank assembly 500 is removed. In some embodiments, such as the illustrated embodiment, a gasket 584 may be coupled to the valve 580 adjacent the outlet aperture to inhibit fluid leakage when the supply tank assembly 500 is supported on the extractor 20.

Figure 13:
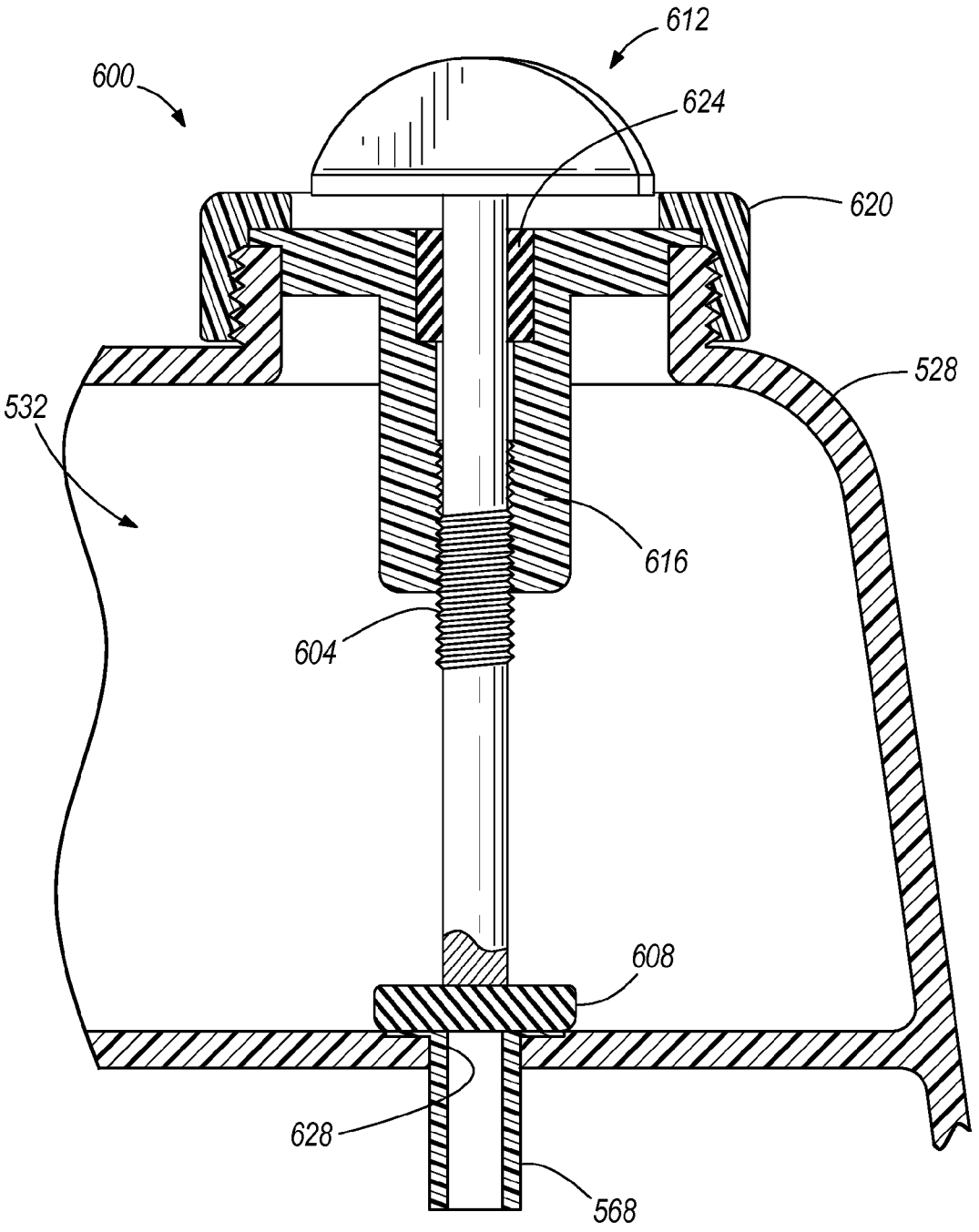
FIG. 13 illustrates a valve assembly for use with the supply tank shown in FIG. 11 according to another embodiment of the invention.

FIG. 13 illustrates another embodiment of a valve assembly 600 for use with the supply tank assembly 500 of FIG. 11. The illustrated valve assembly 600 includes a threaded shaft 604, a sealing member 608, and an actuator 612. The threaded shaft 604 extends through an internally-threaded support bracket 616 coupled to the body 528 of the second tank 508. In the illustrated embodiment, the support bracket 616 is secured to the second tank 508 by a sleeve nut 620. The sleeve nut 620 may be loosened and the valve assembly 600 may be temporarily removed to refill the second tank 508. In other embodiments, the support bracket 616 may be integrally formed as a single piece with the second tank 508. The threaded shaft 604 is rotatable relative to the support bracket 616 to move axially within the second tank 508. A packing seal 624 is positioned between a portion of the shaft 604 and the support bracket 616 to inhibit fluid leakage from the second tank 508.

The sealing member 608 is coupled to an end of the threaded shaft 604 opposite the support bracket 616. In the illustrated embodiment, the sealing member 608 is a relatively flat disk that blocks or unblocks an outlet aperture 628 formed in the second tank 508 to inhibit or allow fluid flow out of the second chamber 532. As the threaded shaft 604 is rotated, the sealing member 608 moves axially with the shaft 604 toward or away from the outlet aperture 628 to block or unblock the outlet aperture 628. When the sealing member 608 tightly engages the bottom surface 552 of the body 528, the sealing member 608 inhibits fluid from flowing out of the second chamber 532 and into the fluid conduit 568. When the sealing member 608 is spaced apart from the bottom surface 552, the sealing member 608 allows fluid flow into the conduit 568. As such, a user can finely adjust the amount of fluid flowing out of the second tank 508 by rotating the threaded shaft 604 a small degree. In other embodiments, the sealing member 608 may be generally conically-shaped and the outlet aperture 628 may be defined by a generally conically-shaped surface. In such embodiments, the conical sealing member could move into and seal against the conical aperture to allow fine adjustment of the mixing ratio.

The actuator 612 is coupled to an upper portion of the threaded shaft 604 to facilitate rotating the threaded shaft 604. In the illustrated embodiment, the actuator 612 is a dial that is integrally formed with the threaded shaft 604 and manually rotatable by a user. In other embodiments, the actuator 612 may be a separate member that is coupled to the threaded shaft 604. In further embodiments, other suitable actuators may also or alternatively be employed.

Figure 14:
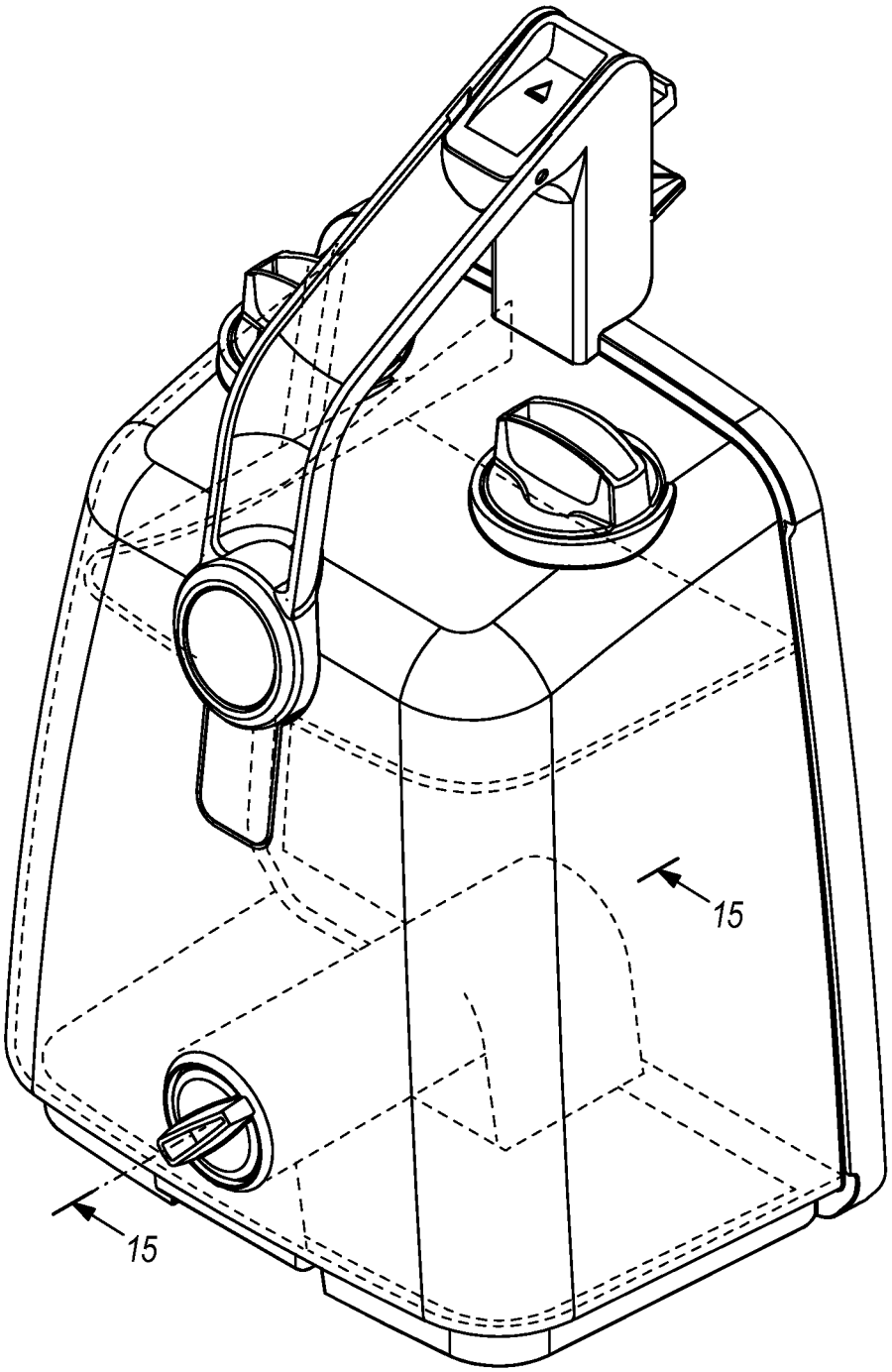
FIG. 14 is a perspective view of yet another embodiment of a supply tank for use with the extractor cleaning machine shown in FIG. 1
Figure 15:
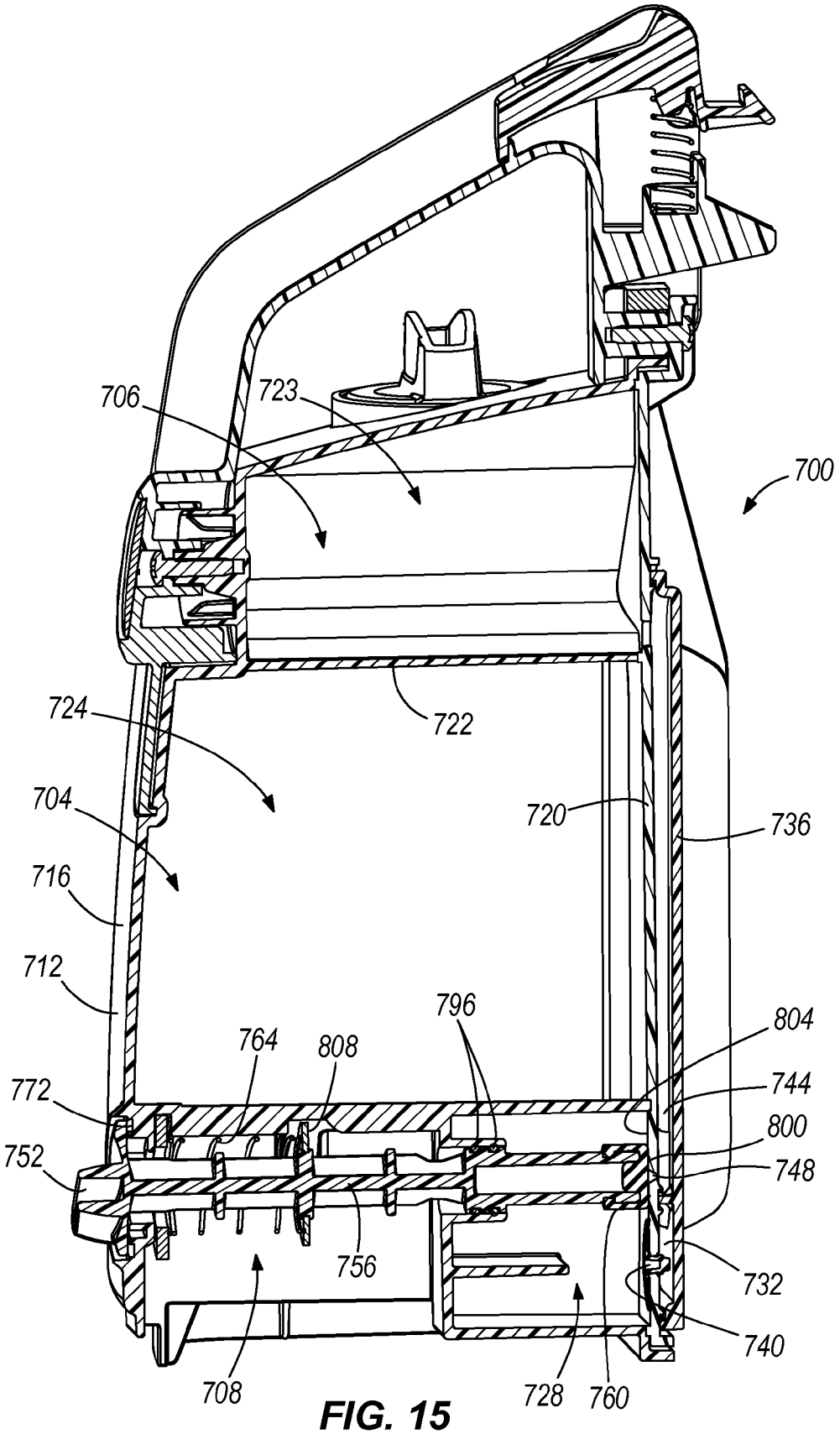
FIG. 15 is a cross-sectional view of the supply tank of FIG. 14 taken along lines 15-15 of FIG. 14.
Figure 16:
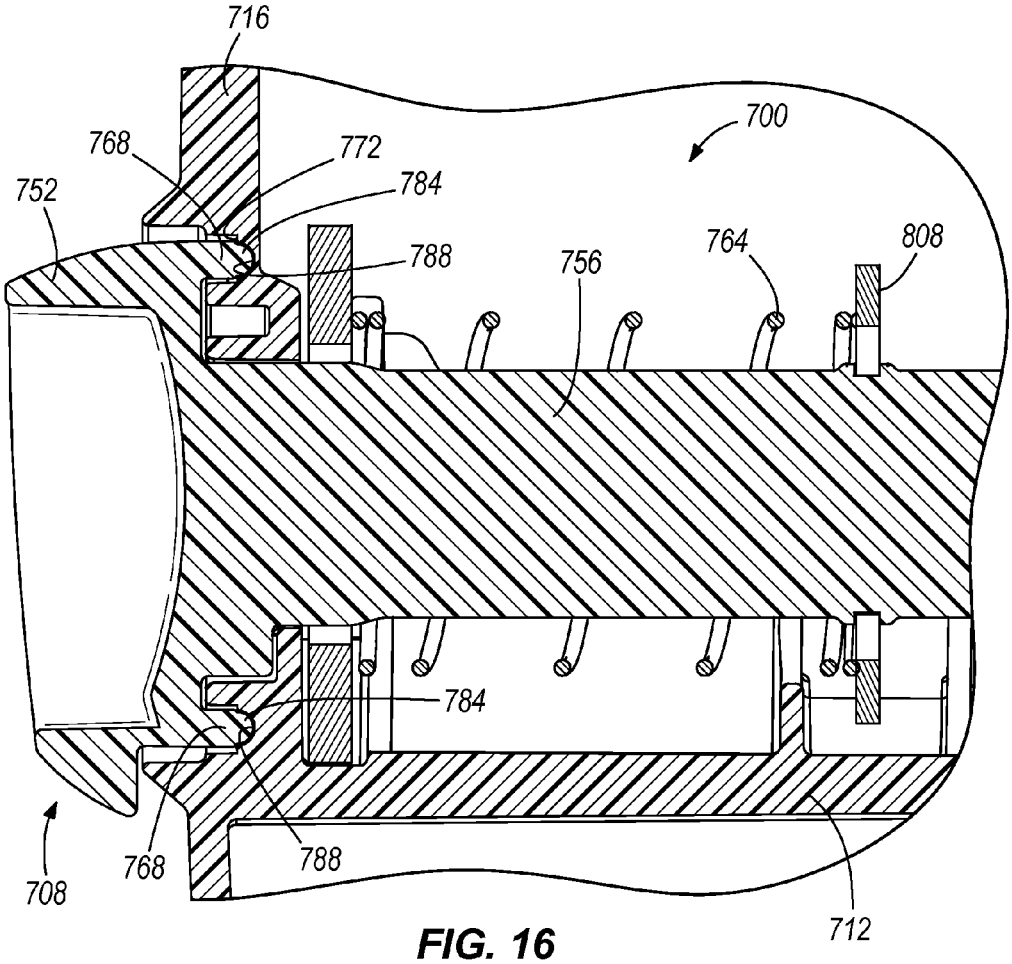
FIG. 16 is an enlarged cross-sectional view of a portion of the supply tank of FIG. 15.
Figure 17:
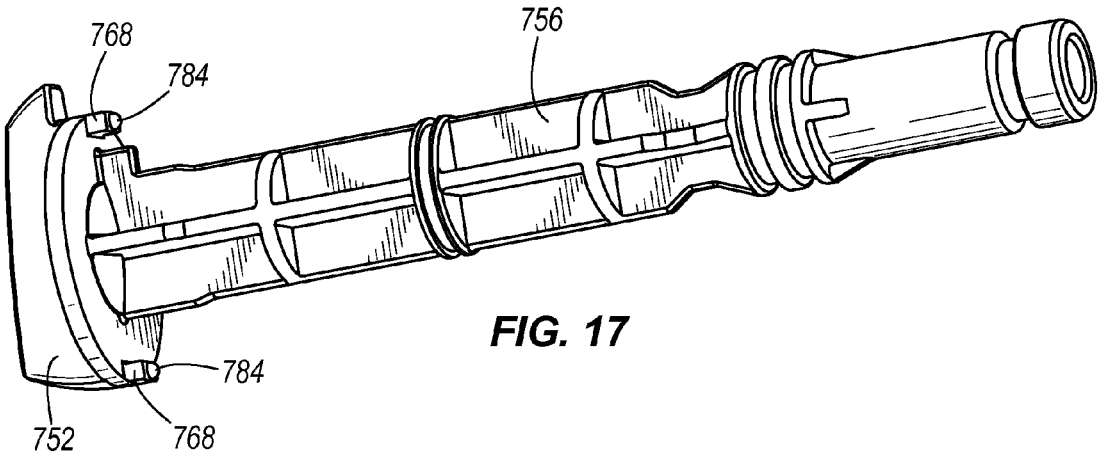
FIG. 17 is a perspective view of a portion of a valve assembly of the supply tank of FIG. 14.

FIG. 14 illustrates another embodiment of a supply tank assembly 700 for use with the extractor 20. The illustrated supply tank assembly 700 includes a first tank 704, a second tank 706 and a valve assembly 708. The first tank 704 includes a body 712 having a front body portion 716 and a rear body portion 720. The front and rear body portions 716, 720 are coupled together to define a first chamber 724 for storing a first cleaning fluid. The front body portion 716, the rear body portion 720, and an inner wall 722 define a second chamber 723 of the second tank 706 for storing a second cleaning fluid, similar to the second chamber 108 shown in FIG. 4.

The front and rear body portions 716, 720 also define a mixing chamber 728 in a lower portion of the body 712. The first chamber 724 is in fluid communication with the mixing chamber 728 via a first channel 732 defined between the rear body portion 720 and a cover 736. A check valve 740 is coupled to the rear body portion 720 adjacent the first channel 732 to selectively allow fluid flow from the first channel 732 into the mixing chamber 728. The second chamber is in fluid communication with the mixing chamber 728 via a second channel 744 defined between the rear body portion 720 and the cover 736. An inlet 748 is formed in the rear body portion 720 adjacent the second channel 744 to allow fluid flow from the second channel 744 into the mixing chamber 728. The valve assembly 708 selectively blocks the inlet 748 to prohibit fluid flow from the second chamber into the mixing chamber 728.

Figure 18:
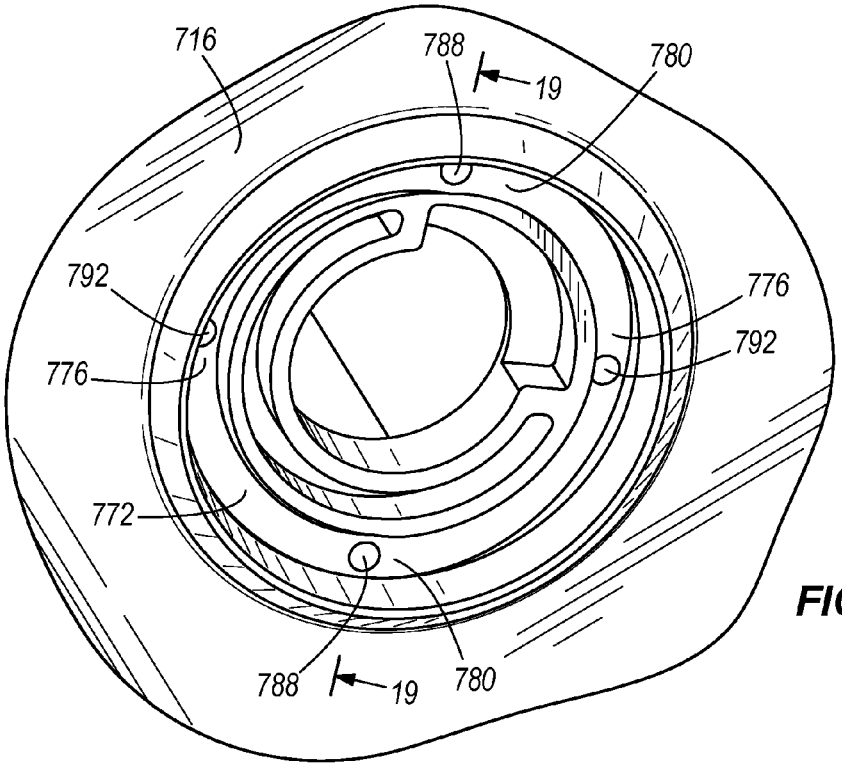
FIG. 18 is an enlarged view of a portion of the supply tank shown in FIG. 14.
Figure 19:
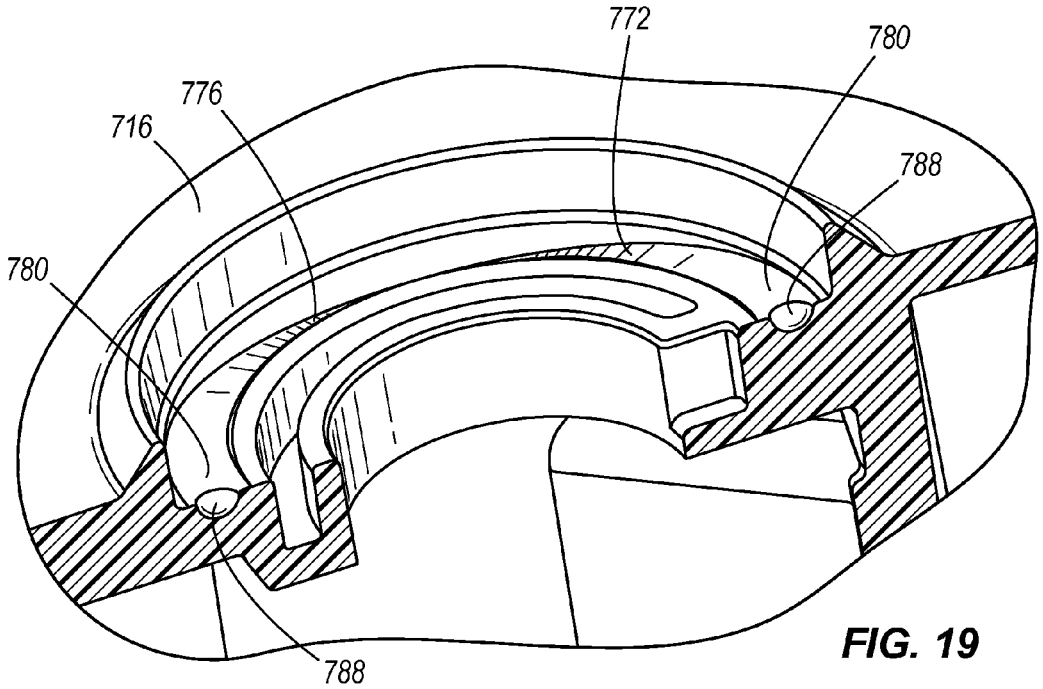
FIG. 19 is an enlarged cross-sectional view of a portion of the supply tank shown in FIG. 14.

The valve assembly 708 is coupled to the front body portion 716 and extends into the mixing chamber 728. As shown in FIGS. 15-18, the valve assembly 708 includes an actuator 752, an elongated shaft 756, a sealing member 760, and a biasing member 764. The actuator 752 extends from the front body portion 716 and is manually rotatable by a user. Two ribs 768 extend from the actuator 752 toward a cam surface 772 formed on the front body portion 716. As shown in FIGS. 18-19, the cam surface 772 includes recessed portions 776 and protruding portions 780. The ribs 768 engage the cam surface 772 and follow the contour of the recessed and protruding portions 776, 780 to move the elongated shaft 756 along a longitudinal axis of the shaft 756 relative to the tank body 712. In the illustrated embodiment, the actuator 752 also includes detents 784 (FIGS. 16-17) formed on the ribs 768.

The detents 784 releasably engage corresponding recesses 788, 792 formed in the cam surface 772 to define two discrete operating positions of the valve assembly 708. In other embodiments, additional recesses may be formed in the cam surface 772 to define three or more operating positions of the valve assembly 708.

Referring back to FIG. 15, the elongated shaft 756 extends from the actuator 752 and through the mixing chamber 728 toward the rear body portion 720. In the illustrated embodiment, the elongated shaft 756 and the actuator 752 are integrally formed as a single piece. In other embodiments, the elongated shaft 756 and the actuator 752 may be separate pieces that are coupled together. Annular seals 796 (e.g., O-rings) are positioned about a portion of the shaft 756 adjacent the mixing chamber 728 to inhibit fluid leakage out of the mixing chamber 728.

The sealing member 760 is coupled to an end of the elongated shaft 756 opposite the actuator 752. The sealing member 760 may be formed of, for example, an elastomeric material. The sealing member 760 has a planar surface 800 that engages an inner surface 804 of the rear body portion 720 to selectively block fluid flow through the inlet 748.

The biasing member 764 surrounds the elongated shaft 756 and extends between the front body portion 716 and a flange 808 mounted to the shaft 756. The biasing member 764 biases the shaft 756 toward the rear body portion 720 to maintain engagement between the actuator 752 and the cam surface 772 on the front body portion 716. In the illustrated embodiment, the biasing member 764 is a coil spring. In other embodiments, other suitable biasing members may also or alternatively be employed.

In operation, the valve assembly 708 is movable between a first, or open, position (i.e., a wash position) and a second, or closed, position (i.e., a rinse position) by rotating the actuator 752. When in the open position, the actuator 752 is positioned such that the ribs 768 engage the protruding portions 780 of the cam surface 772 and the detents 784 sit in the first set of recesses 788 (FIG. 19). In this position, the elongated shaft 756 is moved away from the rear body portion 720 against the force of the biasing member 764. The sealing member 760 is thereby spaced slightly apart from the rear body portion 720 to allow fluid (e.g., detergent) flow through the inlet 748 to the mixing chamber 728. When in the closed position, the actuator 752 is positioned such that the ribs 768 engage the recessed portions 776 of the cam surface 772 and the detents 784 sit in the second set of recesses 792 (FIG. 18). In this position, the elongated shaft 756 is moved toward the rear body portion 720 by the biasing member 764. The sealing member 760 thereby tightly engages the rear body portion 720 to block the inlet 748 and inhibit fluid flow from the second channel 744 into the mixing chamber 728.

Figure 21:
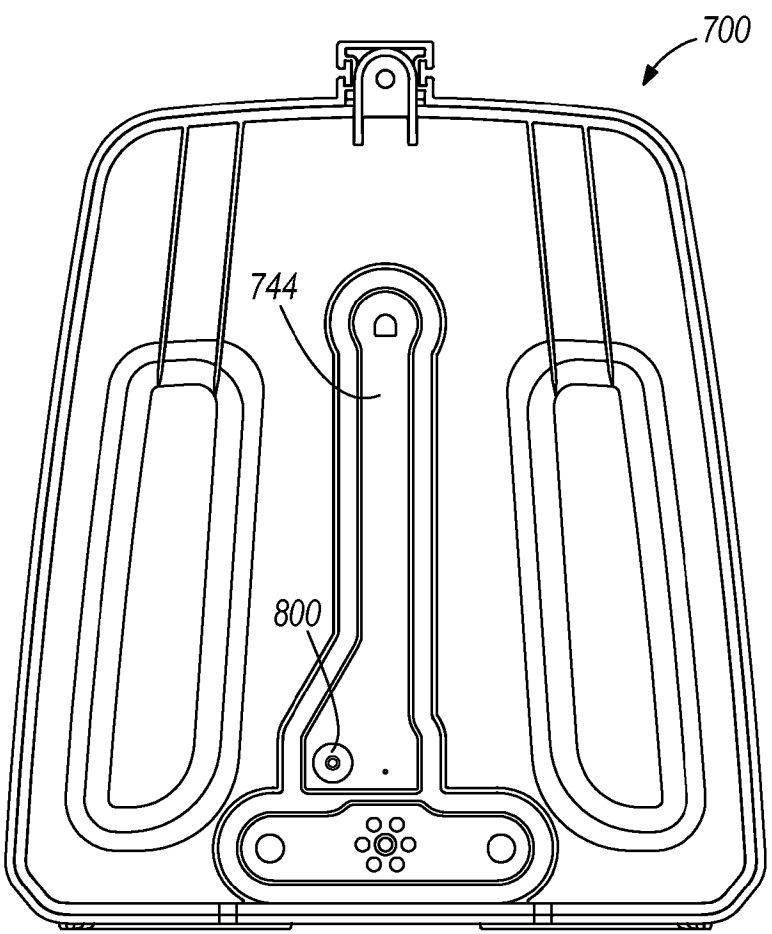
FIG. 21 is a rear side view of the supply tank assembly of FIG. 20.
Figure 20:
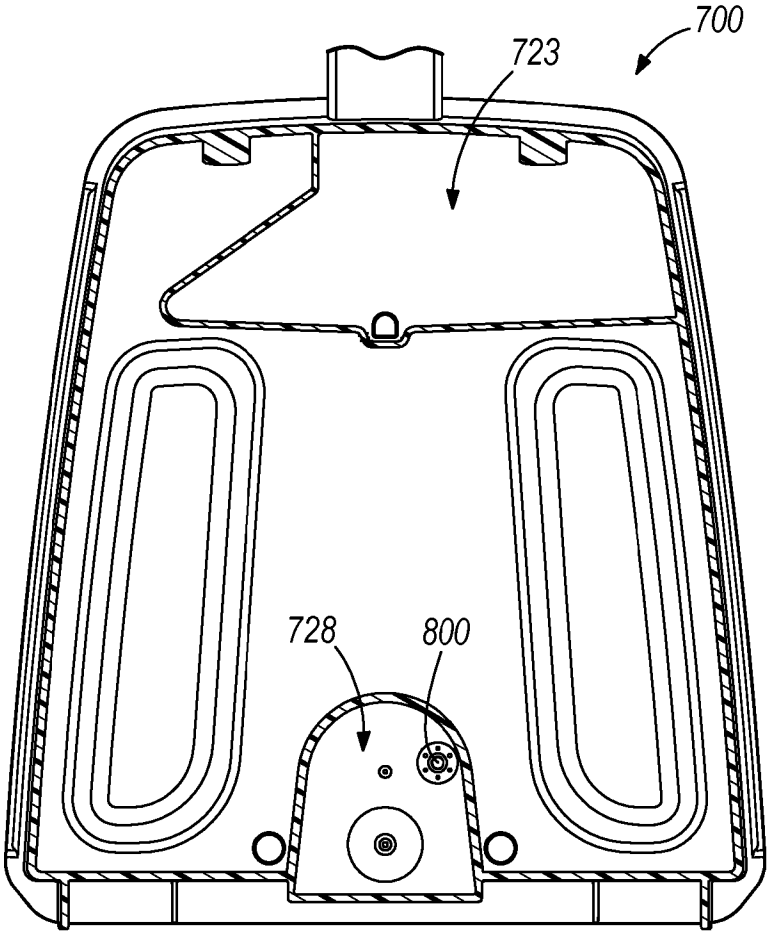
FIG. 20 is a cross-sectional view of a portion of a supply tank for use with the extractor cleaning machine of FIG. 1 according to another embodiment.

In another embodiment, referring to FIGS. 20 and 21, the mixing chamber 728 can include a pressure relief valve 800. In the illustrated embodiment, the pressure relieve valve 800 is an umbrella valve, but in other embodiments, other suitable types of valves can be used. When pressure in the mixing chamber 728 is greater than a predetermined pressure, the valve 800 opens to allow fluid in the mixing chamber 728 to travel into the channel 744 and toward the second chamber 723. However, the pressure relief valve 800 does not allow fluid to flow in the opposite direction (i.e., from the camber 723 toward the mixing chamber 728). The pressure relief valve 800 is particularly suited for extractors that use a pump to pressurize the fluid that flows from the tank 700 to the surface being cleaned. In such extractors, when the extractor is turned off (i.e., the pump is turned off), fluid can flow back through the pump and into the mixing chamber 728, which can increase the pressure in the mixing chamber 728 above a desirable level. The pressure relief valve 800 can then vent the undesirable pressure to the larger volume chamber 723.

Although the invention has been described in detail with reference to certain preferred embodiments, variations and modifications exist within the scope and spirit of one or more independent aspects of the invention as described.

What is claimed is:

1. An extractor cleaning machine comprising:

a base movable along a surface to be cleaned, the base including a distribution nozzle and a suction nozzle;

a suction source in fluid communication with the suction nozzle, the suction source operable to draw fluid from the surface through the suction nozzle;

a recovery tank in fluid communication with the suction source and the suction nozzle to receive the fluid drawn through the suction nozzle;

a handle pivotally coupled to the base, the handle configured to move the base along the surface to be cleaned; and a supply tank removably coupled to the handle, the supply tank including:

a first chamber for storing a first fluid, a second chamber for storing a second fluid, and a third chamber in fluid communication with the first chamber and the second chamber to receive the first and second fluids, the third chamber also in fluid communication with the distribution nozzle for supplying a mixture of the first and second fluids to the distribution nozzle, wherein the first chamber, the second chamber, and the third chamber are simultaneously removable as a single unit from the handle, and wherein the supply tank, including the first, second and third chambers, is coupled to the handle such that the supply tank pivots with the handle relative to the base.

2. The extractor cleaning machine of claim 1, wherein the supply tank is removably coupled to the handle.

3. The extractor cleaning machine of claim 1, wherein the handle is pivotable with respect to the base between an upright storage position and an inclined operating position, and wherein when the handle is in the upright storage position, the first, the second, and the third storage chambers of the supply tank are above and over the recovery tank.

4. The extractor cleaning machine of claim 1, wherein the supply tank includes a pressure relief valve operable to provide selective fluid communication from the third chamber toward the second chamber.

5. The extractor cleaning machine of claim 1, wherein the supply tank further includes a valve assembly operable to control the amount of the second fluid being supplied from the second chamber to the third chamber.

6. The extractor cleaning machine of claim 5, wherein the first chamber, the second chamber, the third chamber, and the valve assembly are removable as a single unit from the body.

7. The extractor cleaning machine of claim 1, wherein the handle is pivotally coupled to the base between an upright storage position and an inclined operating position, and wherein the second chamber of the supply tank is positioned above a majority of the first chamber when the handle is in the upright and inclined positions.

8. The extractor cleaning machine of claim 1, wherein the supply tank includes a body and a rear wall formed as a single component coupled to the body, and wherein the rear wall and the body define at least a portion of the first, the second, and the third chambers.

9. An extractor cleaning machine comprising:

a base movable along a surface to be cleaned, the base including a distribution nozzle and a suction nozzle;

a body including the base;

a handle configured to move the base along the surface to be cleaned;

a suction source in fluid communication with the suction nozzle, the suction source operable to draw fluid from the surface through the suction nozzle;

a recovery tank in fluid communication with the suction source to receive the fluid drawn through the suction nozzle; and a supply tank including:

a first tank including a body for storing a first fluid, a second tank including a body sharing a common boundary with the body of the first tank for storing a second fluid, a mixing chamber sharing a common boundary with at least one of the body of the first tank and the body of the second tank, the mixing chamber in fluid communication with the first tank and the second tank for receiving the first and second fluids, the mixing chamber also in fluid communication with the distribution nozzle for supplying a mixture of the first and the second fluids to the distribution nozzle, and a valve assembly that is operable to control an amount of second cleaning fluid being supplied from the second tank to the mixing chamber, wherein the supply tank, including the first tank, the second tank, the mixing chamber, and the valve assembly, is simultaneously removable as a single unit from the body.

10. The extractor cleaning machine of claim 9, wherein the supply tank is removably coupled to the handle and the recovery tank is removably coupled to the base, wherein the handle is pivotable with respect to the base between an upright storage position and an inclined operating position, and wherein when the handle is in the upright storage position, the first tank, the second tank, and the mixing chamber of the supply tank are above and over the recovery tank.

11. The extractor cleaning machine of claim 9, wherein the mixing chamber includes a first inlet in fluid communication with the first tank, a second inlet in fluid communication with the second tank, and an outlet in fluid communication with the distribution nozzle, wherein the first fluid is configured to flow into the mixing chamber via the first inlet and the second fluid is configured to flow into the mixing chamber via the second inlet to mix with the first fluid, and wherein the mixture of the first fluid and the second fluid is configured to exit the supply tank via the outlet.

12. The extractor cleaning machine of claim 9, wherein the handle is pivotally coupled to the base between an upright storage position and an inclined operating position, wherein the supply tank, including the first tank, the second tank, and the mixing chamber, is coupled to the handle such that the supply tank pivots with the handle relative to the base, and wherein the second tank of the supply tank is positioned above a majority of the first tank when the handle is in the upright and inclined positions.

13. The extractor cleaning machine of claim 9, wherein the supply tank includes a body and a rear wall formed as a single component coupled to the body, and wherein the rear wall and the body defines at least a portion of the first tank, the second tank, and the mixing chamber.

* * * * *